US007855689B2

(12) United States Patent
Fukui et al.

(10) Patent No.: US 7,855,689 B2
(45) Date of Patent: Dec. 21, 2010

(54) ANTENNA APPARATUS FOR RADIO COMMUNICATION

(75) Inventors: Shinji Fukui, Okazaki (JP); Mitsuru Fujita, Toyohashi (JP)

(73) Assignees: Nippon Soken, Inc., Nishio, Aichi-Pref. (JP); Denso Corporation, Kariya, Aichi-Pref. (JP)

( * ) Notice: Subject to any disclaimer, the term of this patent is extended or adjusted under 35 U.S.C. 154(b) by 220 days.

(21) Appl. No.: 12/210,513

(22) Filed: Sep. 15, 2008

(65) Prior Publication Data

US 2009/0079637 A1 Mar. 26, 2009

(30) Foreign Application Priority Data

Sep. 26, 2007 (JP) ..... 2007-250002
Jul. 22, 2008 (JP) ..... 2008-188591

(51) Int. Cl.
*H01Q 11/02* (2006.01)
*H01Q 21/30* (2006.01)

(52) U.S. Cl. ..... 343/731; 343/846; 343/909

(58) Field of Classification Search ..... 343/700 MS, 343/731, 846, 829, 909
See application file for complete search history.

(56) References Cited

U.S. PATENT DOCUMENTS 6,262,495 B1 7/2001 Yablonovitch et al.
6,483,481 B1 * 11/2002 Sievenpiper et al. ..... 343/909
6,518,931 B1 2/2003 Sievenpiper
6,545,647 B1 4/2003 Sievenpiper et al.
7,145,518 B2 12/2006 Tanaka et al.

FOREIGN PATENT DOCUMENTS

| | | |
|---|---|---|
| JP | 2001-267834 | 9/2001 |
| JP | 2002-510886 | 4/2002 |
| JP | 2003-527017 | 9/2003 |
| JP | 2003-304113 | 10/2003 |
| JP | 2004-535722 | 11/2004 |
| JP | 2005-012554 | 1/2005 |
| JP | 2005-039594 | 2/2005 |

(Continued)

OTHER PUBLICATIONS

Japanese Office Action dated Aug. 25, 2009, issued in corresponding Japanese Application No. 2008-188591, with English translation.

(Continued)

*Primary Examiner*—Michael C Wimer
(74) *Attorney, Agent, or Firm*—Nixon & Vanderhye PC

(57) ABSTRACT

An antenna apparatus has a ground plane and a traveling-wave linear antenna The ground plane has a dielectric layer and metallic plates disposed on the dielectric layer. The plates placed on a front side of the ground plane act as a band gap surface. The dielectric constant and thickness of the dielectric layer, the number of plates and the width of spaces among the plates are adjusted, so that the band gap surface prevents propagation of electromagnetic waves within a specific frequency band. The antenna is disposed over the band gap surface on the front side of the ground plane to be spaced away from the band gap surface. The antenna radiates electromagnetic waves of an operational frequency within the specific frequency band in response to an alternating current of the operational frequency fed to the linear antenna.

16 Claims, 18 Drawing Sheets

FOREIGN PATENT DOCUMENTS

| | | |
|---|---|---|
| JP | 2005-110273 | 4/2005 |
| JP | 2006-253929 | 9/2006 |

OTHER PUBLICATIONS

H. Nakano et al, "Effects of the Radiation Characteristics of Using a Corrugated Reflector with a Helical Antenna and an Electromagnetic Band-Gap Reflector with a Spiral Antenna" IEEE Transactions on Antennas and Propagation, IEEE, Jan. 2005, vol. 53, No. 1, Part 1, pp. 191-199.

* cited by examiner

ANTENNA APPARATUS FOR RADIO COMMUNICATION

CROSS-REFERENCE TO RELATED APPLICATION

This application is based upon and claims the benefit of priority of the prior Japanese Patent Application 2007-250002 filed on Sep. 26, 2007 and the prior Japanese Patent Application 2008-188591 filed on Jul. 22, 2008, so that the contents of which are incorporated herein by reference.

BACKGROUND OF THE INVENTION

1. Field of the Invention

The present invention relates to an antenna apparatus having a ground plane and a linear antenna disposed on the ground plane.

2. Description of Related Art

As a system for radio-communicating between a base station and each of on-board terminal devices, a global positioning system and a system of an electronic toll collection are, for example, well known. In these systems, circularly polarized electric waves are used to reliably receive the electric waves in antennas of the terminal devices regardless of the coming direction of the electric waves. As antennas of the terminal devices receiving circularly polarized waves, patch antennas are often used. The patch antenna generally has a ground plane and a patch conductor disposed on the ground plane. The patch antenna is a narrow band and wide beam antenna. This antenna is, for example, disclosed in Published Japanese Patent First Publication No. 2001-267834.

The patch antenna is placed at a specific position of a vehicle from where electric waves radiated from the antenna can be transmitted without being reflected by any objects or disturbing the visual appearance of the vehicle, and where a visual field of the driver is not disturbed by the antenna. For example, the patch antenna is mounted on an upper side of an instrument panel, is incorporated into the panel or a rear view mirror, or is placed at a position near the mirror.

Further, because the antenna is placed in a narrow vehicle compartment, the antenna should be made in a small size, and the antenna should have specific radiation characteristics so as to sufficiently lower the intensity of electric waves radiated toward the back side of the antenna. These characteristics prevent the antenna from receiving unnecessary electric waves reflected by objects on the rear side of the vehicle compartment.

However, to sufficiently give these characteristics to the patch antenna, the patch antenna is required to have the ground plane set in an infinite size. Therefore, a small-sized patch antenna cannot sufficiently lower the intensity of electric waves radiated toward the back side of the antenna.

SUMMARY OF THE INVENTION

An object of the present invention is to provide, with due consideration to the drawbacks of the conventional antenna, an antenna apparatus which is downsized and has specific radiation characteristics so as to sufficiently lower the intensity of electric waves radiated in the back direction of the antenna apparatus.

According to an aspect of this invention, the object is achieved by the provision of an antenna apparatus which comprises aground plane having a band gap surface on a first side of the ground plane and a traveling wave linear antenna disposed over the band gap surface on the first side of the ground plane to be spaced away from the band gap surface. The band gap surface is conductive and substantially prevents propagation of electromagnetic waves set within a specific frequency band. The antenna radiates electromagnetic waves of an operational frequency placed within the specific frequency band in response to an alternating current of the operational frequency inputted to the linear antenna to output a communication signal contained in the alternating current.

With this structure of the antenna apparatus, when an alternating current with a communication signal is inputted to the linear antenna, the current is changed to electromagnetic waves with the signal in the linear antenna, and the electromagnetic waves are radiated from the linear antenna to a base station. Therefore, a terminal with the antenna apparatus can radio-communicate with the base station.

During this communication, the ground plane having the band gap surface acts as a so-called high impedance ground plane having a high impedance for an alternating current of the specific frequency band.

In a conventional antenna apparatus having no high impedance ground plane, a linear antenna is disposed over a ground plane having no high impedance for an alternating current of the specific frequency band. When an alternating current of the specific frequency band flows through this linear antenna, an image current having the same frequency as that of the alternating current flows through the ground plane in response to the alternating current so as to cancel out the alternating current of the antenna. That is, a mirror image (i.e., reverse image) is formed in the ground plane. Therefore, radiation characteristics of the antenna receiving electromagnetic waves based on the image current are degraded. Further, as the antenna approaches the ground plane, the image current induced in the ground plane is increased. Therefore, to prevent this problem in the conventional antenna apparatus, the antenna is disposed to be sufficiently far away from the ground plane. However, electric waves radiated from the antenna are easily directed in the back direction of the antenna apparatus at a high intensity.

In contrast, in the antenna apparatus according to this invention, the band gap surface of the ground plane facing the linear antenna has a high impedance for an alternating current of the specific frequency band. Therefore, when an alternating current of the specific frequency band flows through the antenna, no mirror image is substantially formed on the band gap surface of the ground plane. Further, even when the distance between the antenna and the ground plane is set as small as possible, no mirror image is substantially formed on the band gap surface. Therefore, the antenna can be disposed close to the ground plane. That is, the antenna apparatus can be made in a low profile. Accordingly, the antenna apparatus can be downsized in the thickness direction of the apparatus.

Further, because the antenna is disposed close to the ground plane, the antenna apparatus prevents electromagnetic waves from propagating over the surface of the ground plane so as to leak toward the back side of the ground plane opposite to the first side. Therefore, the antenna apparatus substantially suppresses electromagnetic waves leaked toward the back side of the ground plane. In the conventional antenna apparatus, to reduce leakage of electromagnetic waves toward the back side of the ground plane, it is required to enlarge the size of the ground plane in the face directions perpendicular to the thickness direction. Accordingly, the antenna apparatus according to this invention can efficiently suppress leakage of electromagnetic waves in the back side of the ground plane while downsizing the ground plane in the face directions. That is, the antenna apparatus has specific radiation characteristics so as to sufficiently lower the intensity of electric waves radiated in the back direction of the antenna apparatus.

Moreover, the antenna forbids propagation of standing waves but allows propagation of traveling waves. That is, no resonant frequency exists in the antenna. Accordingly, as compared with a standing wave antenna, the antenna apparatus can radiate electromagnetic waves in a wider frequency band.

DETAILED DESCRIPTION OF THE PREFERRED EMBODIMENTS

Figure 1:
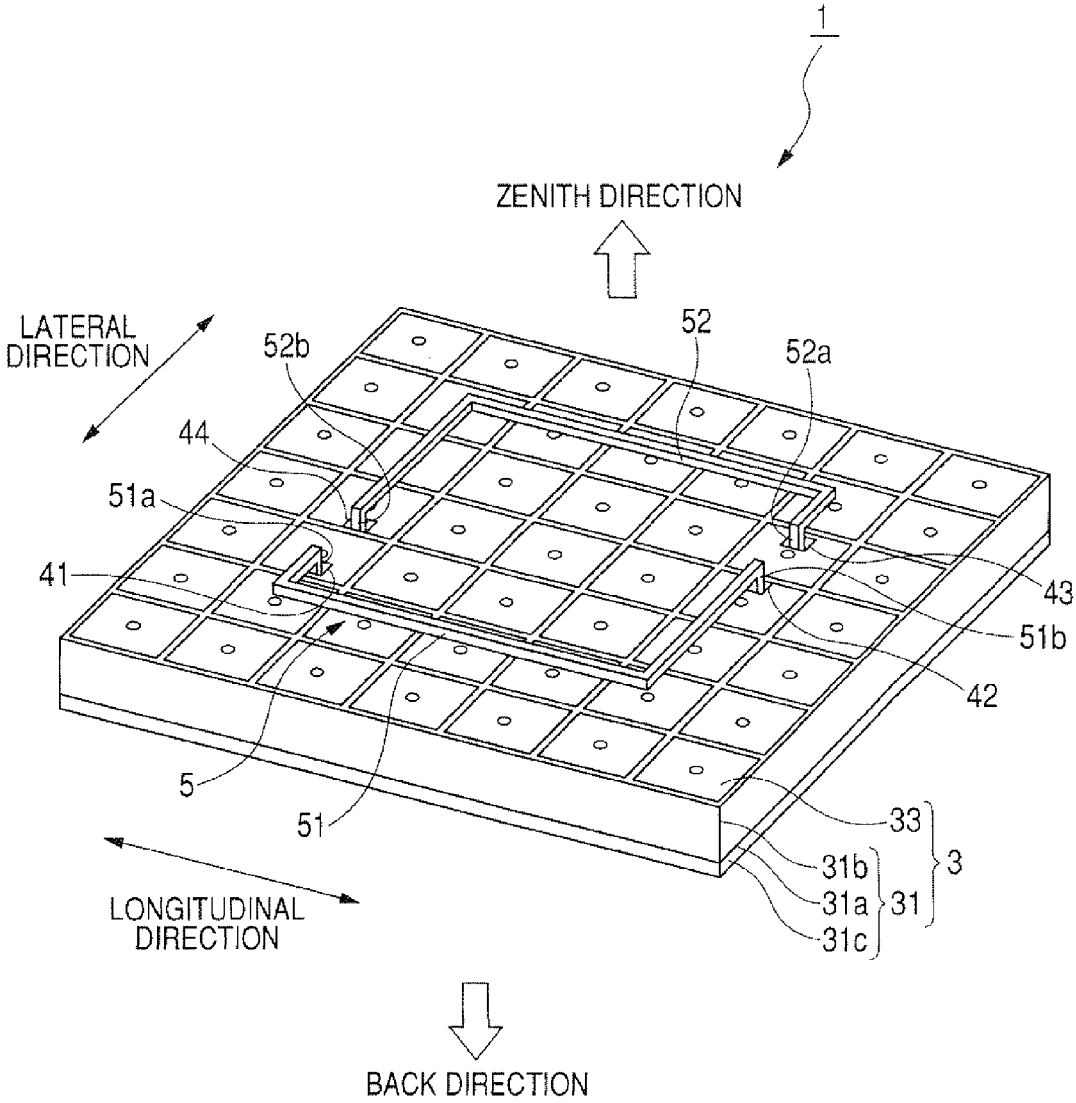
FIG. 1 is a perspective side view of an antenna apparatus according to the first embodiment of the present invention.

Embodiments of the present invention will now be described with reference to the accompanying drawings, in which like reference numerals indicate like parts, members or elements throughout the specification unless otherwise indicated.

Embodiment 1

Figure 2A:
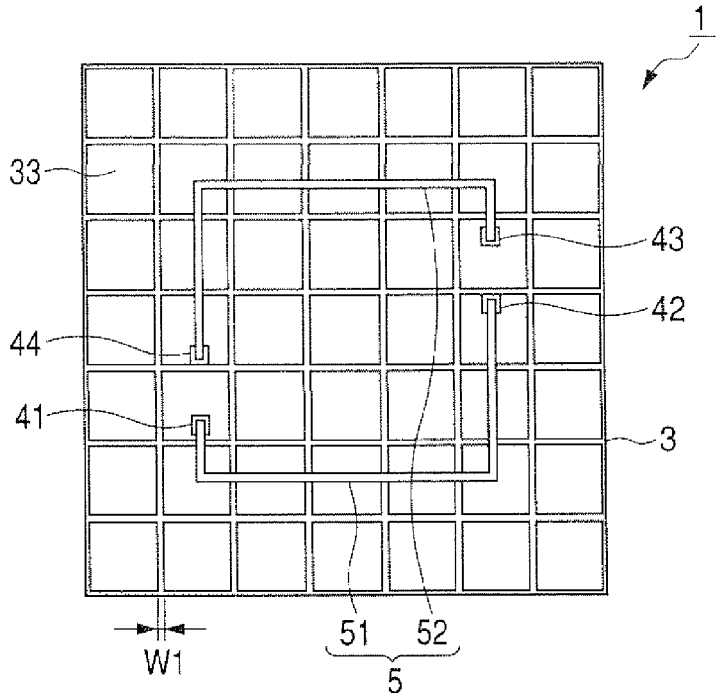
FIG. 2A is a front view of the antenna apparatus shown in FIG. 1.
Figure 2B:
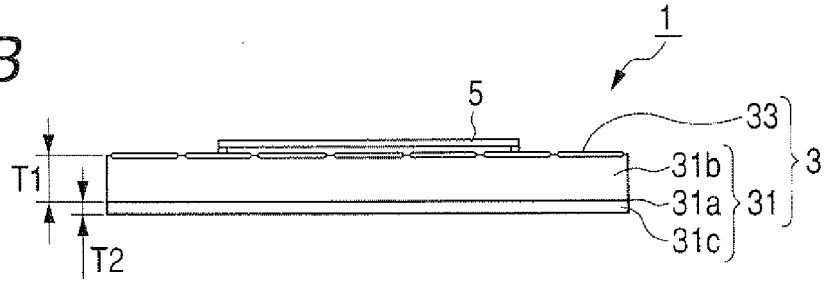
FIG. 2B is a side view of the antenna apparatus shown in FIG. 1.
Figure 2C:
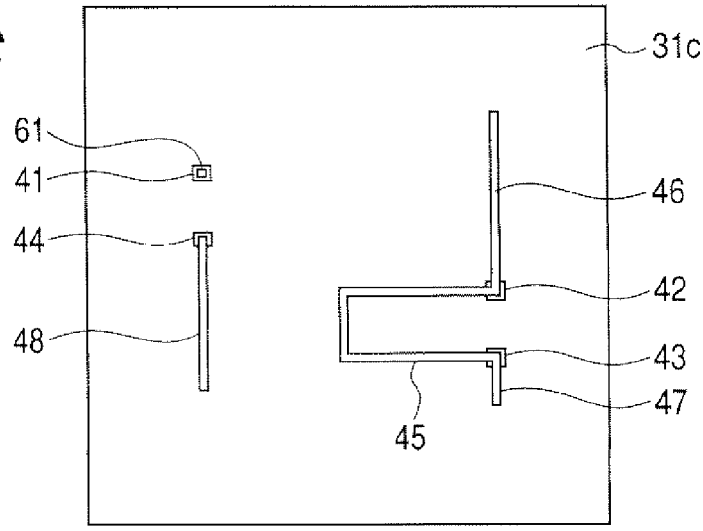
FIG. 2C is a back view of the antenna apparatus shown in FIG. 1.

FIG. 1 is a perspective side view of an antenna apparatus according to the first embodiment. FIG. 2A is a front view of the antenna apparatus shown in FIG. 1, FIG. 2B is a side view of the antenna apparatus shown in FIG. 1, and FIG. 2C is a back view of the antenna apparatus shown in FIG. 1.

As shown in FIG. 1 and FIG. 2A, an antenna apparatus 1 has a ground plane 3 formed in a rectangular parallelepiped and a radiation element 5 radiating electromagnetic waves. As described later in detail, the ground plane 3 has an electromagnetic band gap surface (or an electromagnetic band gap plate) on the front side of the ground plane 3. The band gap surface is conductive and has a high impedance for an alternating current of a specific frequency band to substantially prevent propagation of electromagnetic waves set within the specific frequency band.

The radiation element 5 has a first linear antenna 51 and a second linear antenna 52 paired with each other. The antennas 51 and 52 are disposed over the band gap surface on the front side of the ground plane 3 to be spaced away from the band gap surface. Each of the antennas 51 and 52 has a total length approximately equal to a half of one wavelength corresponding to an operational frequency of a specific frequency band, so that each of the antennas 51 and 52 is adapted to radiate or receive electromagnetic waves of the operational frequency or an operational frequency band approximately having the operational frequency in the center of the band. That is, in response to a high frequency current of the operational frequency or the operational frequency band flowing through the antennas 51 and 52, each of the antennas 51 and 52 radiates electromagnetic waves of the operational frequency or the operational frequency band. Further, in response to electromagnetic waves of the operational frequency or the operational frequency band received in each of the antennas 51 and 52, a high frequency current set at the same frequency as that of the waves flows through the antennas 51 and 52.

Each of the antennas 51 and 52 is formed approximately in a U shape so as to be curved toward the lateral direction of the apparatus 1 at each of side portions of the antenna 51 at 90 degrees. Therefore, each of the antennas 51 and 52 has a center portion extending straight in the longitudinal direction of the apparatus 1, a shorter side portion extending straight from one end of the center portion in the lateral direction, and a longer side portion extending straight from the other end of the center portion in the lateral direction. That is, each of the antennas 51 and 52 is formed in the Crank-Line type. The shorter side portion is shorter than the longer side portion. In each of the antennas 51 and 52, the shorter and longer side portions face each other through the center portion in a plane parallel to the front surface of the ground plane 3.

The combination of the antennas 51 and 52 is shaped to be symmetric in rotation of 180 degrees with respect to the center of the antennas 51 and 52. More specifically, the combination of the antennas 51 and 52 approximately forms four sides of a square, and the center of the antennas 51 and 52 is located at the center of the square When the combination of the antennas 51 and 52 is rotated on the center of the square by 180 degrees, the position of the combination of the antennas 51 and 52 rotated is the same as that not rotated.

Because each of the antennas 51 and 52 is curved and is, for example, formed in the Crank-Line types each of the antennas 51 and 52 radiates and receives circularly polarized waves of the operational frequency or the operational frequency band.

The ground plane 3 has four attaching holes 41, 42, 43 and 44. Each of the holes 41 to 44 extends from the front side to the back side of the ground plane 3 to penetrate through the ground plane 3 in the thickness direction of the plane 3. The radiation element 5 has an end portion 51*a* which extends from the shorter side portion of the antenna 51 and is inserted into the attaching hole 41. The radiation element 5 has an end portion 51*b* which extends from the longer side portion of the antenna 51 and is inserted into the attaching hole 42. The radiation element 5 has an end portion 52*a* which extends from the shorter side portion of the antenna 52 and is inserted into the attaching hole 43. The radiation element 5 has an end portion 52*b* which extends from the longer side portion of the antenna 52 and is inserted into the attaching hole 44.

As shown in FIG. 1, FIG. 2A and FIG. 2B, the ground plane 3 has a ground plane base portion 31 and a plurality of small metallic plates 33 disposed on the front surface of the portion 31. The base portion 31 has a thinned conductive layer 31*a* made of metal, a first dielectric layer 31*b* disposed on the upper surface of the layer 31*a*, and a second dielectric layer 31*c* disposed on the lower surface of the layer 31*a*. Therefore, the conductive layer 31*a* is placed between inner surfaces of the dielectric layers 31*b* and 31*c*. The thickness T1 of the layer 31*b* is larger than the thickness T2 of the layer 31*c*. Each metallic plate 33 is disposed on the outer surface of the layer 31*b*. The metallic plates 33 are formed in the same square shape and are is arranged longitudinally and laterally to be spaced from one another at equal intervals W1. The metallic plates 33 are spaced from the antennas 51 and 52 at a constant distance. The width W1 is set to be five or more times as large as the constant distance.

Figure 3:
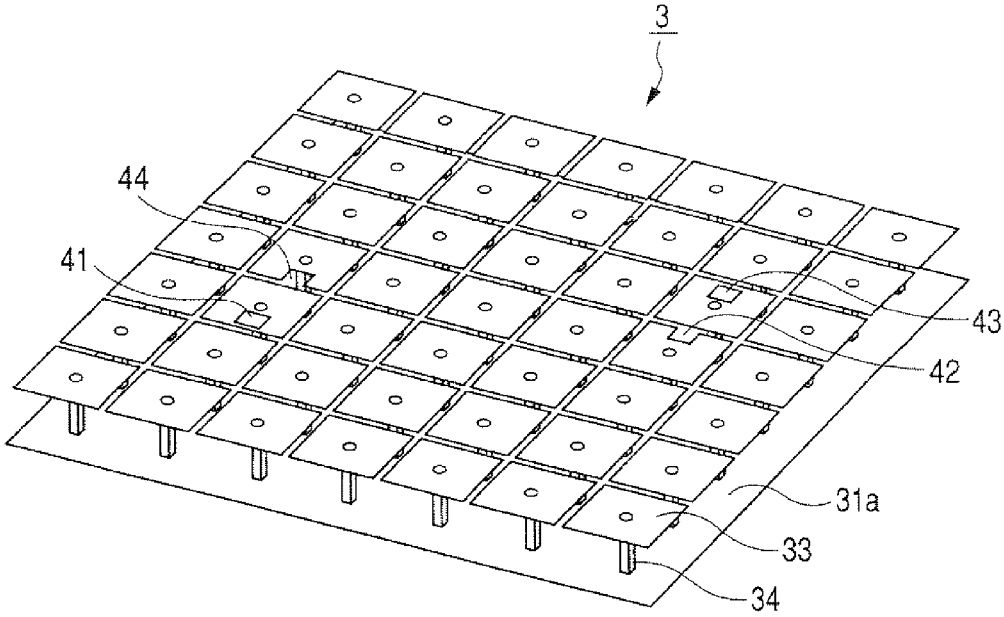
FIG. 3 is a perspective side view of a ground plane of the antenna apparatus excluding dielectric layers.

FIG. 3 is a perspective side view of the ground plane 3 excluding the dielectric layers 31*b* and 31*c*. As shown in FIG. 3, the ground plane 3 further has a plurality of connection portions 34 connecting the respective plates 33 with the conductive layer 31*a*. The portions 34 are made of metal, so that each plate 33 is electrically connected with the conductive layer 31*a*.

The ground plane 3 is, for example, produced by forming a plurality of through holes having a pattern of the connection portions 34 in the dielectric layer 31*b* in advance, printing a pattern of the metallic plates 33 on the outer surface of the layer 31*b*, forming a metallic film on the inner and outer surfaces of the layer 31*b* by metal plating while filling the through holes with the metal film to form the conductive layer 31*a* on the inner surface of the layer 31*b* and to form the connection portions 34 in the through holes, partially removing the metallic film from the outer surface of the layer 31*b* to form the plates 33, and depositing a dielectric film on the conductive layer 31*a* to form the dielectric layer 31*c*. Therefore, the ground plane 3 can be easily produced. A square pattern shown in the center of each plate 33 indicates a shape of one through hole formed when the metallic film is deposited on the outer surface of the layer 31*b*.

To form the holes 41 to 44 in the ground plane 3, four metallic plates 33 have respective openings, and the conductive layer 31*a* has four openings. Further, each of the dielectric layers 31*b* and 31*c* has four openings. To prevent the end portions 51*a*, 51*b*, 52*a* and 52*b* of the radiation element 5 from being in contact with the plates 33 or the layer 31*a*, each of the holes 41 to 44 is covered with the insulating material forming the layers 31*b* and 31*c*. Therefore, the end portions 51*a* and 51*b* pass through the holes 41 and 42 without being in contact with the plates 33 or the conductive layer 31*a*, and the end portions 52*a* and 52*b* pass through the holes 43 and 44 without being in contact with the plates 33 or the conductive layer 31*a*.

As shown in FIG. 2C, the holes 41 to 44 are opened on the outer surface of the dielectric layer 31*c* (i.e., the back surface of the ground plane 3). The end portion 51*a* extending from the antenna 51 is used as a feed point 61 on the outer surface of the dielectric layer 31*c*. The end portion 51*a* is connected with a high frequency connecter (not shown) at the feed point 61 to receive a high frequency current from an external device (not shown).

Figure 4:
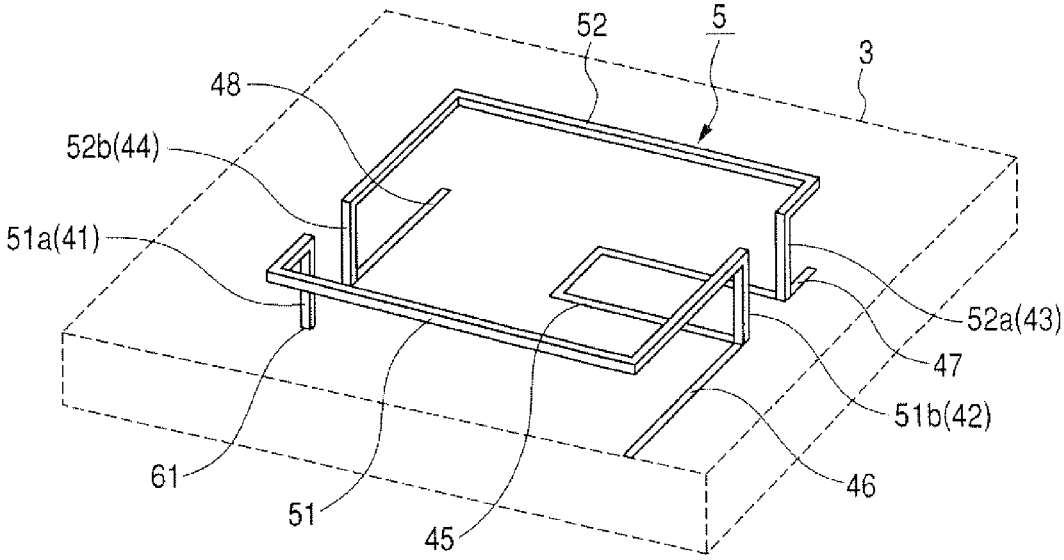
FIG. 4 is a perspective side view of a radiation element of the antenna apparatus shown in FIG. 1.

FIG. 4 is a perspective side view of the radiation element 5.

As shown in FIG. 2C and FIG. 4, the radiation element 5 further has a connection line 45 connecting the end portions 51*b* and 52*a*, a first matching stub 46 connected with the end portion 51*b*, a second matching stub 47 connected with the end portion 52*a*, and a third matching stub 48 connected with the end portion 52*b*. The connection line 45 and the stubs 46 to 48 are disposed on grooves formed on the outer surface of the dielectric layer 31*c*. The connection line 45 is formed approximately in a U shape. Each of the stubs 46 to 48 and the connection line 45 is formed of a microstrip line. A communication signal superimposed onto a high frequency alternating current of the operational frequency band is received at the feed point 61 of the end portion 51*a* and passes through the antenna 51, the connection line 45 and the antenna 52 in that order.

The length of the connection line 45 is set to appropriately adjust a phase difference between the current passing through the antenna 51 and the current passing through the antenna 52. Therefore, the antennas 51 and 52 can radiate electromagnetic waves circularly polarized with high precision, and the antennas 51 and 52 can radiate electromagnetic waves in a desired direction.

The electric resistance of the stub 46 is adjusted to terminate the antenna 51 while substantially preventing the current or signal transmitted through the antenna 51 from being reflected at a boundary between the antenna 51 and the connection line 45. That is, the stub 46 has substantially the same resistance as the characteristic impedance of the antenna 51. The electric resistance of the stub 47 is adjusted to substantially prevent the current or signal transmitted through the connection line 45 from being reflected at a boundary between the antenna 52 and the connection line 45. That is, the stub 47 has substantially the same resistance as the characteristic impedance of the connection line 45. The electric resistance of the stub 48 is adjusted to substantially prevent the current or signal transmitted through the antenna 52 from being reflected at the tip of the antenna 52. That is, the stub 48 has substantially the same resistance as the characteristic impedance of the antenna 52.

Because the stubs 46 to 48 terminate each of the antennas 51 and 52 and prevent reflections of the current transmitted through the antennas 51 and 52, the antennas 51 and 52 allow only traveling waves of the current fed at the feed point 61 but prohibit reflected waves derived from the traveling waves. Therefore, the antenna apparatus 1 having the antennas 51 and 52 substantially acts as a traveling-wave antenna wherein only traveling waves substantially pass through the antennas 51 and 52. The antenna apparatus 1 differs from a standing-wave antenna wherein standing waves are resonated in an antenna element.

The metallic plates 33 face the antennas 51 and 52 at a constant distance. To form the surface of the metallic plates 33 facing the antennas 51 and 52 as a band gap surface having a high impedance for a high frequency current set within the specific frequency band, the thickness T1 and the relative dielectric constant $\epsilon$1 of the dielectric layer 31*b*, the thickness T2 and the relative dielectric constant $\epsilon$2 of the dielectric layer 31*c*, the number of metallic plates 33, the size of each metallic plate 33 and the space width W1 between metallic plates 33 are appropriately adjusted.

Therefore, the band gap surface has a high impedance for a high frequency current of the specific frequency band to substantially prevent an alternating current of the specific frequency band from being transmitted through the metallic plates 33 and to substantially prevent propagation of electromagnetic waves of the specific frequency band induced by the alternating current.

More specifically, the ground plane 3 has the dielectric layers 31*b* and 31*c*, the conductive layer 31*a* placed between the dielectric layers 31*b* and 31*c*, the metallic plates 33 longitudinally and laterally disposed on the outer surface of the dielectric layer 31*b* and spaced from one another, and the connection portions 34 connecting the respective plates 33 with the conductive layer 31*a*. This structure of the ground plane 3 is called an electromagnetic band gap (EBG) structure. Each pair of adjacent metallic plates 33 spaced from each other forms a capacitor having a capacitance. An inductor having an inductance is formed in a current path connecting two metallic plates 33 in each pair. The path connects one plate 33, the connection portion 34 corresponding to the plate 33, the conductive layer 31*a*, another connection portion 34 and the metallic plate 33 corresponding to the another connection portion 34 in that order. Therefore, the ground plane 3 has a large number of LC resonance circuits connected in parallel to one another, and the ground plane 3 is expressed by an equivalent circuit of the LC resonance circuits. This equivalent circuit has a resonance frequency.

When an alternating current of a frequency band including the resonance frequency attempts to flow through the metallic plates 33, the impedance for surface waves of the current flowing through the surface of the metallic plates 33 is considerably heightened. Therefore, the ground plane 3 resists the alternating current to pass through the surface of the metallic plates 33 (i.e., the band gap surface). That is, the band gap surface has a high impedance for an alternating current of a frequency band including the resonance frequency of the equivalent circuit. The ground plane 3 is structured such that the resonance frequency of the equivalent circuit is substantially equal to the operational frequency.

Next, an operation of the antenna apparatus 1 is described below.

When the antenna apparatus 1 acts as a transmitter, a communication signal to be communicated with a base station (not shown) is superimposed onto a high frequency current of the operational frequency band belonging to the specific frequency band. Then, the high frequency current with the signal is received at the feed point 61 of the end portion 51*a* and passes through the antenna 51, the connection line 45 and the antenna 52 in that order. In response to the current passing through the antennas 51 and 52, the antennas 51 and 52 radiate electromagnetic waves of the operational frequency band. In this case, the stubs 46 to 48 prevent the current from being reflected in the antennas 51 and 52. The connection line 45 appropriately sets the radiation direction of the electromagnetic waves by adjusting the phase difference between the currents of the antennas 51 and 52. For example, the intensity of the radiated electromagnetic waves is maximized in the zenith direction perpendicular to the ground plane 3. Further, the connection line 45 appropriately adjusts the phase difference to precisely polarize the electromagnetic waves.

In response to the electromagnetic waves radiated from the antennas 51 and 52, an image current of the same frequency band as that of the high frequency current is induced to flow through the surface of the metallic plates 33 of the ground plane 3 such that the metallic plates 33 radiate electromagnetic waves to the antennas 51 and 52 in response to this image current to reduce the current of the antennas 51 and 52. Therefore, the image current acts to cancel out the current of the antennas 51 and 52. However, because the band gap surface is set at a high impedance for the high frequency current of the specific frequency band, no image current of the specific frequency band substantially flows through the metallic plates 33. That is, the band gap surface prevents propagation of electromagnetic waves of the specific frequency band induced by an image current.

Accordingly, the antenna apparatus 1 can radiate circularly polarized electromagnetic waves of the specific frequency band toward the zenith direction at a sufficiently high intensity.

When the antenna apparatus 1 acts as a receiver, the antennas 51 and 52 receive circularly polarized electromagnetic waves of a reception frequency placed within the specific frequency band, and a high frequency current of the reception frequency is induced in the antennas 51 and 52. In this case, the band gap surface is set at a high impedance within the specific frequency band. Therefore, when the ground plane receives the electromagnetic waves, no image current canceling out the current of the antennas 51 and 52 substantially flows through the surface of the metallic plates 33. Therefore, the band gap surface prevents propagation of electromagnetic waves radiated from the ground plane in response to the received waves. Accordingly, the antenna apparatus 1 can reliably receive a signal superposed onto the received electromagnetic waves at a sufficient intensity.

Generally, the intensity of an image current flowing through a ground plane in response to an alternating current flowing through an antenna element depends on the distance between the antenna element and the ground plane. As the distance is shortened, the image current is increased. Therefore, in a conventional antenna apparatus, to prevent the formation of the image current having a strong intensity, the antenna element is inevitably placed far away from the ground plane. That is, the size of the conventional antenna apparatus undesirably becomes large in the thickness direction.

However, in this embodiment, the band gap surface is set at a high impedance for the high frequency current set within the specific frequency band, so that no image current substantially flows through the surface of the metallic plates 33 of the ground plane 3. Therefore, the antennas 51 and 52 can be placed nearer to the metallic plates 33 of the ground plane 3. That is, the antenna apparatus 1 can have a very low profile. Accordingly, the antenna apparatus 1 can be thinned so as to be placed in a narrow space.

Further, because the distance between the combination of the antennas 51 and 52 and the ground plane 3 is shortened to be as small as possible, the ground plane 3 placed near the antennas 51 and 52 prevents electromagnetic waves radiated from the antennas 51 and 52 from going around the ground plane 3 to reach the back side of the ground plane 3. Therefore, the antenna apparatus 1 resists electromagnetic waves of the antennas 51 and 52 to be radiated in the back direction opposite to the zenith direction.

Generally, a conventional patch antenna has a patch element disposed on the front side, a metallic ground plane disposed on the back side, and a dielectric layer placed between the patch element and the ground plane. As the area of the ground plane becomes large, the intensity of electric waves radiated in the back direction is lowered. To sufficiently lower the intensity of electric waves radiated in the back direction, a large-sized ground plane is required.

Accordingly, as compared with the conventional patch antenna, the antenna apparatus 1 can efficiently lower the intensity of electromagnetic waves radiated in the back direction while the ground plane 3 is downsized in the face directions.

Figure 5A:
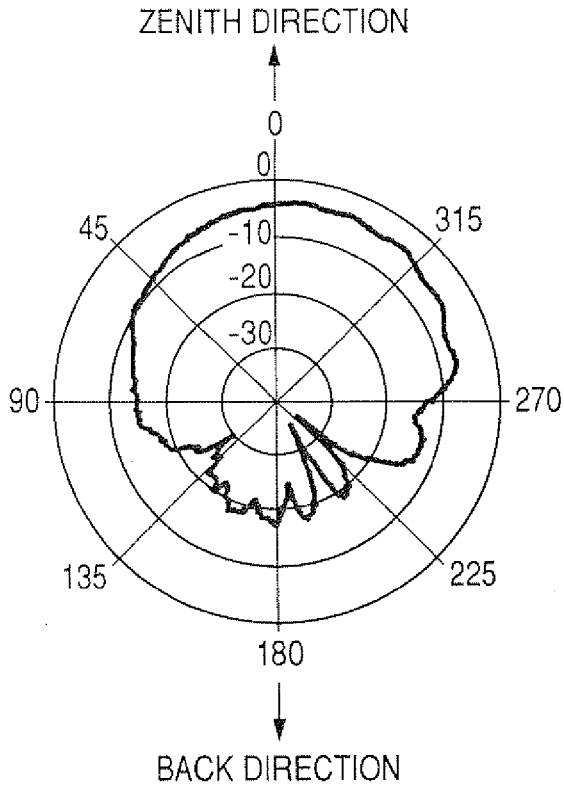
FIG. 5A shows radiation characteristics of a conventional patch antenna.
Figure 5B:
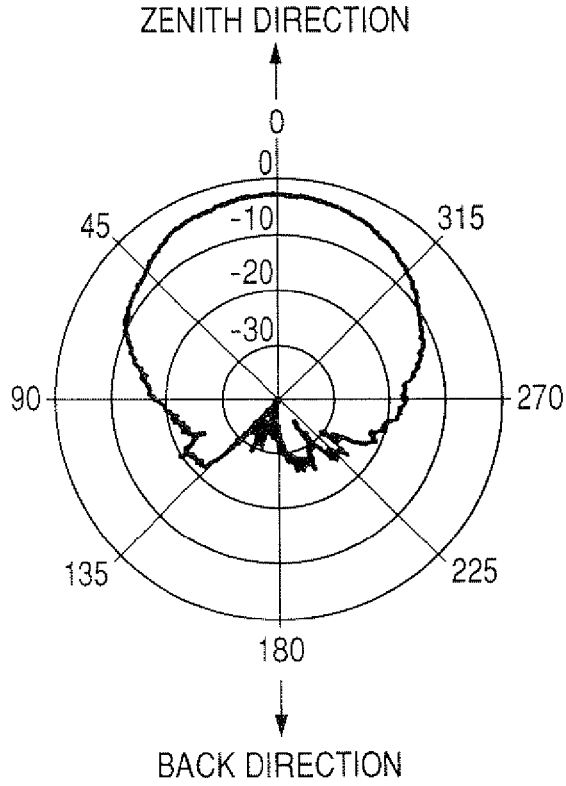
FIG. 5B shows radiation characteristics of the antenna apparatus shown in FIG. 1.

As an example, FIG. 5A shows radiation characteristics of the conventional patch antenna, while FIG. 5B shows radiation characteristics of the antenna apparatus 1. The operational frequency is 5.8 GHz in each of the antenna apparatus 1 and the conventional patch antenna, and the ground plane 3 has the same size as that of a metallic ground plane of the conventional patch antenna in the face directions. In the antenna apparatus 1, the base portion 31 is 60 mm×60 mm×3.2 mm, each of the dielectric layers 31*b* and 31*c* is formed of glass epoxy resin and has the relative dielectric constant approximately equal to 4, each side of the square formed by the antennas 51 and 52 has the length of approximately 20 mm, the space width W1 between metallic plates 33 is approximately set at 5 mm, each metallic plate 33 is formed in a square approximately set at 4.2 by 4.2 mm (4.2×4.2 mm), and the number of metallic plates 33 is 144 (12×12) In the conventional patch antenna, the size of the ground plane is 60 mm×60 mm×0.5 mm, and the size of the dielectric layer is 13 mm×13 mm×5 mm.

As shown in FIG. 5A and FIG. 5B, as compared with the conventional patch antenna, it will be easily realized that the radiation of electromagnetic waves in the back direction is considerably reduced in the antenna apparatus 1. That is, when the intensity of the back radiation in the antenna apparatus 1 is set to be equal to that in the conventional patch antenna, the size of the antenna apparatus 1 in the face directions can be set to be considerably smaller than that of the conventional patch antenna. When the size of the antenna apparatus 1 in the face directions is the same as that of the conventional patch antenna, the intensity of the back radiation in the antenna apparatus 1 can be considerably lowered as compared with that in the conventional patch antenna.

As described above, the antenna apparatus 1 has the ground plane 3 having the band gap surface on the front side of the ground plane 3 and a combination of the traveling-wave linear antennas 51 and 52 disposed over the band gap surface on the front side of the ground plane 3 to be spaced away from the band gap surface. The band gap surface is conductive and has a high impedance for an alternating current of the specific frequency band to substantially prevent propagation of electromagnetic waves set within the specific frequency band. That is, the antennas 51 and 52 are disposed over the high impedance ground plane 3 having the electromagnetic band gap (EBG) structure. The antennas 51 and 52 radiate circularly polarized electromagnetic waves of an operational frequency band belonging to the specific frequency band in response to an alternating current of the operational frequency band fed to the linear antennas 51 and 52, or the linear antennas 51 and 52 receive circularly polarized electromagnetic waves of the operational frequency band to induce an alternating current of the operational frequency band in the linear antennas 51 and 52.

Therefore, when an alternating current of the operational frequency is transmitted through the antennas 51 and 52, no image current having the same frequency as that of the alternating current is substantially transmitted through the metallic plates 33, and the band gap surface substantially radiates no electromagnetic waves acting to cancel out the alternating current of the antennas 51 and 52. Accordingly, the distance between the combination of the antennas 51 and 52 and the ground plane 3 can be set as small as possible, so that the antenna apparatus 1 can have a low profile so as to be in a small size.

Further, because the antenna apparatus 1 has a low profile, the antenna apparatus 1 can reduce the radiation of electromagnetic waves in the back direction, so that the antenna apparatus 1 hardly receives reflected waves from objects placed on the back side of the apparatus 1. Therefore, the antennas 51 and 52 substantially receive no adverse influence from the objects. Accordingly, the antenna apparatus 1 can reliably transmit a signal superimposed onto the radiated electromagnetic waves to a base station, so that the antenna apparatus 1 can radio-communicate with the base station with high precision.

Further, the traveling-wave antenna apparatus 1 forbids the transmission of standing waves in the linear antennas 51 and 52 but allows only the transmission of traveling waves in the linear antennas 51 and 52. Therefore, as compared with a standing-wave antenna using the resonance of standing waves, the operational frequency of the antenna apparatus 1 can be set in a wider frequency band, or the operational frequency band of the antenna apparatus 1 can be widened.

Moreover, when the length of the connection line 45 is changed to appropriately adjust the phase difference between the currents of the antennas 51 and 52, the radiation direction in the antenna apparatus 1 can be appropriately set. For example, the antenna apparatus 1 can radiate electromagnetic waves in a direction shifted from the zenith direction.

Furthermore, the antennas 51 and 52 are curved in the plane perpendicular to the zenith direction to be formed in a Crank-Line type. Therefore, the antennas 51 and 52 radiate or receive circularly polarized electric waves. Especially, the combination of the antennas 51 and 52 is symmetric in rotation of 180 degrees with respect to the center of the antennas 51 and 52. Accordingly, the antenna apparatus 1 can reliably radiate or receive circularly polarized electric waves.

In this embodiment, the antennas 51 and 52 are formed in a square shape. However, the antennas 51 and 52 may extend straight in a line to be formed in a monopole type. With this structure, the antenna apparatus 1 can radiate or receive linearly polarized electric waves.

Figure 6:
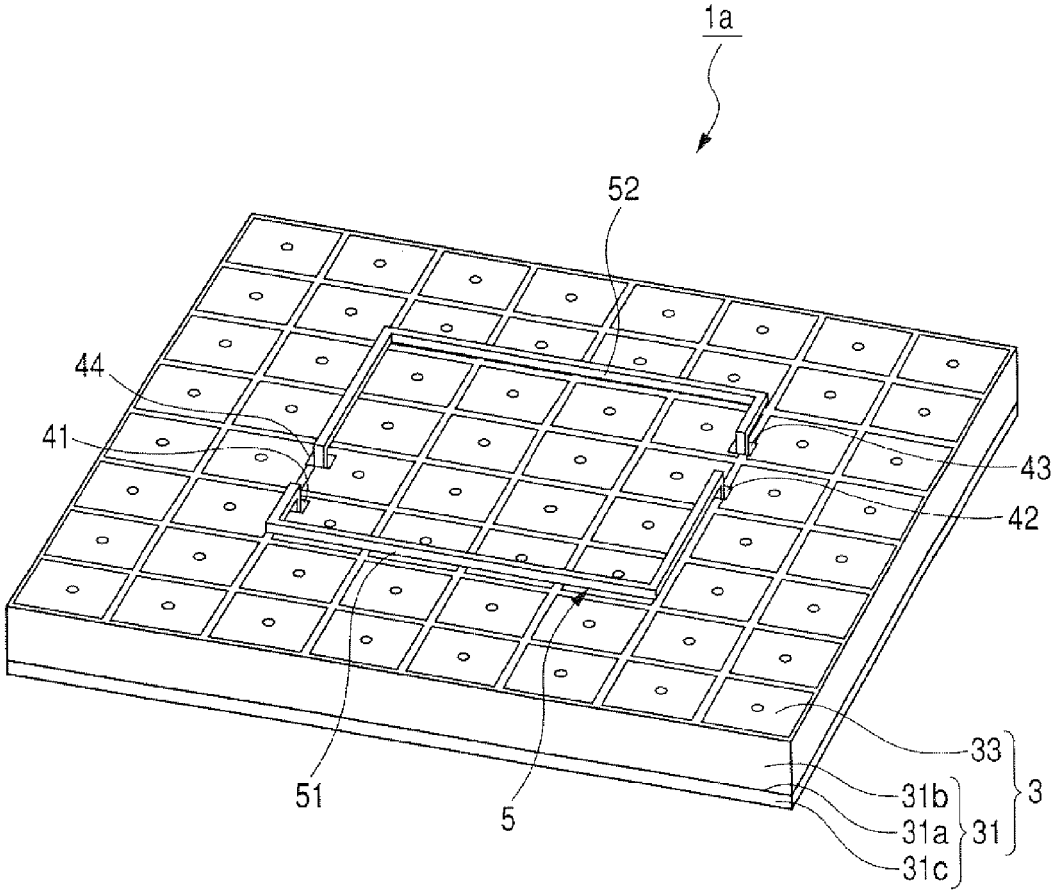
FIG. 6 is a perspective side view of an antenna apparatus according to a modification of the first embodiment.

Further, as shown in FIG. 1 and FIG. 2A, each of the antennas 51 and 52 extends along a line which connects center positions of respective metallic plates 33. However, this embodiment is not limited to the antenna apparatus 1. FIG. 6 is a perspective side view of an antenna apparatus 1*a* according to a modification of the first embodiment. As shown in FIG. 6, the antenna apparatus 1*a* differs from the antenna apparatus 1 in that each of the antennas 51 and 52 extends over openings formed among metallic plates 33. This antenna apparatus 1*a* substantially radiates or receives electromagnetic waves in the same manner as the antenna apparatus 1.

Moreover, in this embodiment, the metallic plates 33 are formed in the same square. However, the plates 33 maybe formed in the same rectangular shape, hexagonal shape, or the like. Further, the plates 33 maybe formed in different shapes.

Furthermore, each of the stubs 46 to 48 and the connection line 45 is formed of a microstrip line. However, each of the stubs 46 to 48 and the connection line 45 may be formed of a strip line or a transmission line.

Embodiment 2

Figure 7:
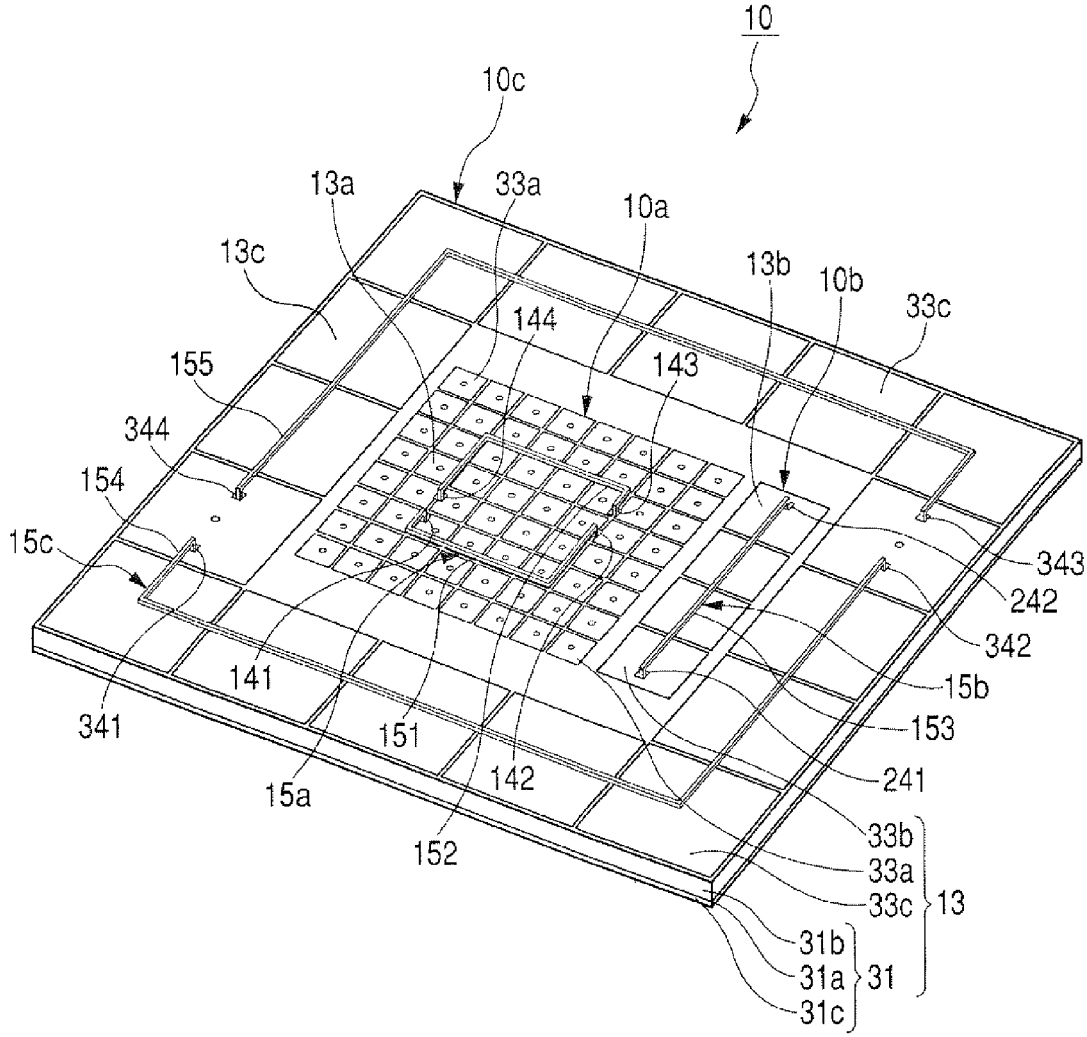
FIG. 7 is a perspective side view of an antenna apparatus according to the second embodiment.
Figure 9:
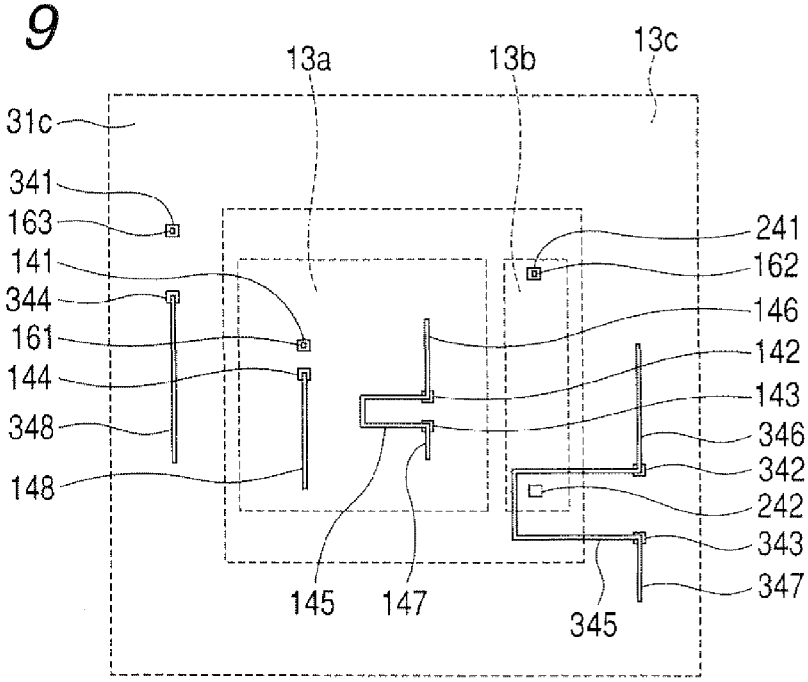
FIG. 9 is aback view of the antenna apparatus shown in FIG. 7.

FIG. 7 is a perspective side view of an antenna apparatus according to the second embodiment. FIG. 5A is a front view of the antenna apparatus shown in FIG. 7. FIG. 5B is a side view of the antenna apparatus shown in FIG. 7. FIG. 9 is a back view of the antenna apparatus shown in FIG. 7.

As shown in FIG. 7, FIG. 8A, FIG. 8B, and FIG. 9, an antenna apparatus 10 has a ground plane 13 formed in a rectangular parallelepiped and a radiation section 15 radiating and receiving electromagnetic waves. The ground plane 13 is partitioned into a first ground plane portion 13*a* disposed in the center of the ground plane 13, a second ground plane portion 13*b* disposed on one side (left side in FIG. 8A) of the portion 13*a*, and a third ground plane portion 13*c* disposed on the periphery of the ground plane 13 so as to surround the portions 13*a* and 13*b*. The plane portions 13*a* to 13*c* are spaced from one another through dielectric (or insulating) parts of the ground plane 13. As described later in detail, in the same manner as in the first embodiment, each of the plane portions 13*a* to 13*c* has a band gap surface which is conductive and has a high impedance for an alternating current of a specific frequency band to substantially prevent propagation of electromagnetic waves set within the specific frequency band. The specific frequency bands of the band gap surfaces are preferably differentiated from one another.

The radiation section 15 has a first radiation element 15*a* corresponding to the first portion 13*a*, a second radiation element 15*b* corresponding to the second portion 13*b*, and a third radiation element 15*c* corresponding to the third portion 13*c*. The antenna apparatus 10 is partitioned into a first antenna section 10*a* having the element 15*a* and the portion 13*a*, a second antenna section 10*b* having the element 15*b* and the portion 13*b*, and a third antenna section 10*c* having the element 15*c* and the portion 13*c*.

The first plane portion 13*a* is structured in the same manner as the ground plane 3 (see FIG. 1). The radiation element 15*a* is structured in the same manner as the radiation element 5 (see FIG. 1). Therefore, the first antenna section 10*a* radiates and receives circularly polarized electromagnetic waves of a first operational frequency or a first operational frequency band placed within a first specific frequency band in the same manner as the antenna apparatus 1.

The radiation element 15*a* has a pair of linear antennas 151 and 152 disposed to be spaced from the plane portion 13*a* by a predetermined distance, two end portions 151*a* and 151*b* which extend from respective ends of the antenna 151 and are inserted into two attaching holes 141 and 142 penetrating through the plane portion 13*a*, two end portions 152*a* and 152*b* which extend from respective ends of the antenna 152 and are inserted into two attaching holes 143 and 144 penetrating through the plane portion 13*a*, a connection line 145 connecting the antennas 151 and 152, and three matching stubs 146, 147 and 148 connected with the respective end portions 151*b*, 152*a* and 152*b*. The end portion 151*a* is used as a feeding point 161 of the first antenna section 10*a*. The antennas 151 and 152, the line 145 and the stubs 146 to 148 act in the same manner as those of the antenna apparatus 1.

Figure 10:
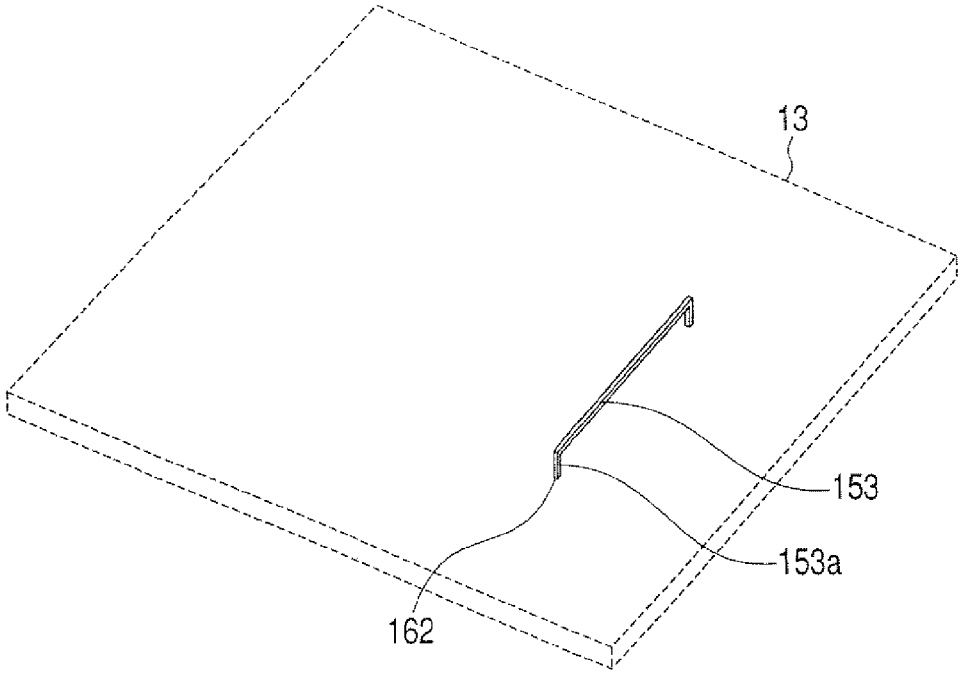
FIG. 10 is a perspective side view of a second radiation element of the antenna apparatus shown in FIG. 7.

FIG. 10 is a perspective side view of the radiation element 15*b*. As shown in FIG. 7, FIG. 8A, FIG. 9 and FIG. 10, the radiation element 15*b* has a single linear antenna 153 and two end portions 153*a* and 153*b*. The end portions 153*a* and 153*b* extend from respective ends of the antenna 153 to be inserted into respective attaching holes 241 and 242 penetrating through the plane portion 13*b*. The end portion 153*a* is used as a feeding point 162 of the section 10*b*. The antenna 153 extends straight and is disposed over the plane portion 13*b* while being spaced from the plane portion 13*b* by a predetermined distance. The antenna 153 has a total length substantially equal to one quarter of one wavelength of an electromagnetic wave set at a second operational frequency placed within a second specific frequency band. The second operational frequency is set to be lower than the first operational frequency. Therefore, a high frequency current of the second operational frequency placed within the second specific frequency band or a second operational frequency band having the second operational frequency in the center of the band can flow through the antenna 153.

The antenna 153 acts as a resonance type antenna, and the antenna 153 radiates or receives linearly polarized electromagnetic waves of the second operational frequency or the second operational frequency band.

Figure 11:
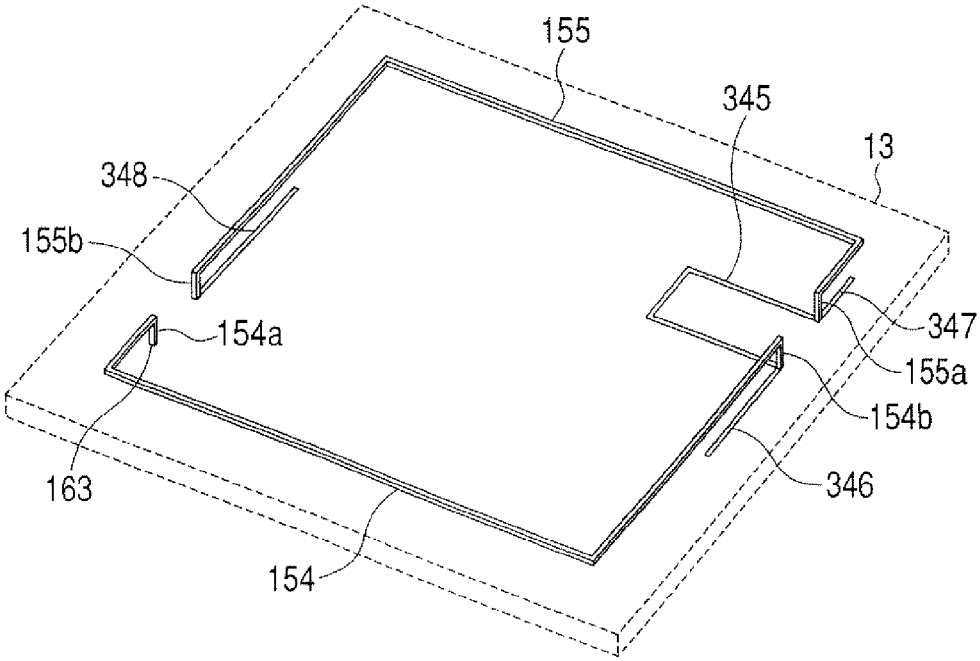
FIG. 11 is a perspective side view of a third radiation element of the antenna apparatus shown in FIG. 7.

FIG. 11 is a perspective side view of the radiation element 15*c*. As shown in FIG. 7, FIG. 8A, FIG. 9 and FIG. 11, the radiation element 15*c* has a pair of linear antenna 154 and 155, two end portions 154*a* and 154*b* extending from respective ends of the antenna 154 to be inserted into two attaching holes 341 and 342 penetrating through the plane portion 13*c*, two end portions 155*a* and 155*b* extending from respective ends of the antenna 155 to be inserted into two attaching holes 343 and 344 penetrating through the plane portion 13*c*, a connection line 345 connecting the end portions 154*b* and 155*a* to electrically connect the antennas 154 and 155, and three matching stubs 346, 347 and 348 connected with the respective end portions 154*b*, 155*a* and 155*b*. The end portion 154*a* is used as a feeding point 163 of the section 10*c*. The antennas 154 and 155 are disposed over the plane portion 13*c* to be spaced from the plane portion 13*c* by a predetermined distance. Each of the antennas 154 and 155 has the same total length which is substantially equal to a half of one wavelength of an electromagnetic wave set at a third operational frequency of a third specific frequency band.

The combination of the antennas 154 and 155 has the similar shape to the combination of the antennas 151 and 152, and the size of the antennas 154 and 155 is larger than that of the antennas 151 and 152. Therefore, a high frequency current of the third operational frequency placed within the third specific frequency band or a third operational frequency band having the third operational frequency in the center of the band can flow through the antennas 154 and 155, and the antennas 154 and 155 radiate or receive circularly polarized electromagnetic waves of the third operational frequency or the third operational frequency band The length of the antenna 154 or 155 is four times longer than the length of the antenna 151 or 152. Therefore, the third operational frequency is lower than the first and second operational frequencies.

The stubs 346 to 348 act in the same manner as those in the first embodiment so as to terminate the antennas 154 and 155 while preventing traveling waves of a high frequency current from being reflected in the antennas 154 and 155. Therefore, in the same manner as the radiation element 5 (see FIG. 1), the radiation element 15*c* acts as a traveling-wave antenna wherein only traveling waves are substantially transmitted through the antennas 154 and 155. The connection line 345 acts in the same manner as that in the first embodiment. Therefore, the radiation element 15*c* radiates circularly polarized electromagnetic waves.

Figure 8A:
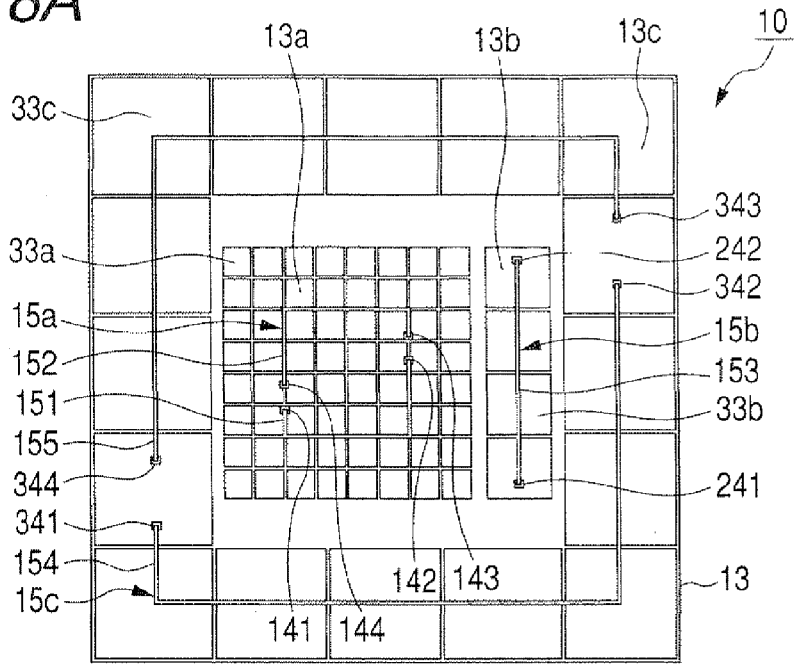
FIG. 8A is a front view of the antenna apparatus shown in FIG. 7.
Figure 8B:
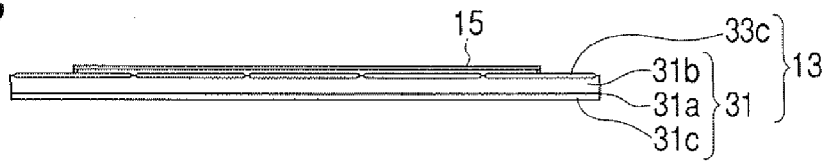
FIG. 8B is a side view of the antenna apparatus shown in FIG. 7.

As shown in FIG. 7 and FIG. 8B, the ground plane 13 is structured approximately in the same manner as the ground plane 3 (see FIG. 1). The ground plane 13 has the base portion 31 composed of the layers 31*a* to 31*c*, a plurality of first metallic plates 33*a* disposed on the outer surface of the dielectric layer 31*b* in the first portion 13*a*, a plurality of second metallic plates 33*b* disposed on the outer surface of the dielectric layer 31*b* in the second portion 13*b*, and a plurality of third metallic plates 33*c* disposed on the outer surface of the dielectric layer 31*b* in the third portion 13*c*. The metallic plates 33*a* are formed in the same square shape and are arranged longitudinally and laterally to be spaced from one another at equal intervals. The metallic plates 33*b* are formed in the same square shape and are arranged longitudinally and laterally to be spaced from one another at equal intervals. The metallic plates 33*c* are formed in the same square shape and are arranged longitudinally and laterally to be spaced from one another at equal intervals.

The surface of the metallic plates 33*a* forms a first band gap surface having a high impedance for a high frequency current of the first specific frequency band. The first band gap surface substantially prevents an alternating current of the first specific frequency band from being transmitted through the metallic plates 33*a* and prevents propagation of electromagnetic waves of the first specific frequency band induced by the alternating current. The surface of the metallic plates 33*b* forms a second band gap surface having a high impedance for a high frequency current of the second specific frequency band. The second band gap surface substantially prevents an alternating current of the second specific frequency band from being transmitted through the metallic plates 33*b* and prevents propagation of electromagnetic waves of the second specific frequency band induced by the alternating current. The surface of the metallic plates 33*c* forms a third band gap surface having a high impedance for a high frequency current of the third specific frequency band. The third band gap surface substantially prevents an alternating current of the third specific frequency band from being transmitted through the metallic plates 33*c* and prevents propagation of electromagnetic waves of the third specific frequency band induced by the alternating current. To form the band gap surfaces, the thickness T1 and the relative dielectric constant $\epsilon$1 of the dielectric layer 31*b*, the thickness T2 and the relative dielectric constant $\epsilon$2 of the dielectric layer 31*c*, the number of metallic plates 33*a*, the number of metallic plates 33*b*, the number of metallic plates 33*c*, the size of each metallic plate 33*a*, the size of each metallic plate 33*b*, the size of each metallic plate 33*c*, the space width between metallic plates 33*a*, the space width between metallic plates 33*b*, and the space width between metallic plates 33*c* are appropriately adjusted in the same manner as in the first embodiment.

The metallic plates 33*a* are spaced from the antennas 151 and 152 at a first constant distance, the metallic plates 33*b* are spaced from the antenna 153 at a second constant distance, and the metallic plates 33*c* are spaced from the antennas 154 and 155 at a third constant distance. The constant distances may be the same value or may be differentiated from one another. Further, the metallic plates 33*a* are spaced from one another by a first width, the metallic plates 33*b* are spaced from one another by a second width, and the metallic plates 33*c* are spaced from one another by a third width. The first width is set to be five or more times as large as the first constant distance. The second width is set to be five or more times as large as the second constant distance. The third width is set to be five or more times as large as the third constant distance.

To differentiate the first, second and third operational frequencies from one another, the size of the plate 33*b* is set to be larger than that of the plate 33*a*, and the size of the plate 33*c* is set to be larger than that of the plate 33*b*. The holes 141, 142, 143, 144, 241, 242, 341, 342, 343 and 344 are formed in the same manner as the holes 41 to 44 in the first embodiment so as to prevent the antennas 151 to 155 from being in contact with the plate 33*a*, 33*b* or 33*c* or the layer 31*a*.

With this structure of the antenna apparatus 10, the first antenna section 10*a* receives and transmits circularly polarized electromagnetic waves having the first operational frequency band belonging to the first specific frequency band. The second antenna section 10*b* receives and transmits linearly polarized electromagnetic waves having the second operational frequency band belonging to the second specific frequency band. The third antenna section 10*c* receives and transmits circularly polarized electromagnetic waves having the third operational frequency band belonging to the third specific frequency band.

Because the plane portions 13*a* to 13*c* have the respective band gap surfaces each of which has a high impedance for a high frequency current of the first, second or third specific frequency band, each of the antenna sections 10*a* to 10*c* is formed in a low profile and receives and transmits electromagnetic waves of the corresponding specific frequency band at a sufficiently high intensity while preventing the waves from being radiated in the back direction.

As is described above, in the second embodiment, the antenna section 10*a* has the plane portion 33*a* having the first band gap surface on the front side of the plane portion 33*a* and the radiation element 15*a* disposed over the first band gap surface on the front side of the plane portion 33*a* to be spaced from the first band gap surface, the antenna section 10*b* has the plane portion 33*b* having the second band gap surface on the front side of the plane portion 33*b* and the radiation element 15*b* disposed over the second band gap surface on the front side of the plane portion 33*b* to be spaced from the second band gap surface, and the antenna section 10*c* has the plane portion 33*c* having the third band gap surface on the front side of the plane portion 33*c* and the radiation element 15*c* disposed over the third band gap surface on the front side of the plane portion 33*c* to be spaced from the third band gap surface. That is, each of the plane portions 33*a* to 33*c* is structured as a high impedance ground plane having the electromagnetic band gap (EBG) structure. Each band gap surface is conductive and has a high impedance for an alternating current of the first, second or third specific frequency band to substantially prevent propagation of electromagnetic waves set within the specific frequency band.

Accordingly, in the same manner as in the first embodiment, each of the antenna sections 10*a* to 10*c* in the antenna apparatus 10 can reliably transmit a signal superimposed onto the radiated electromagnetic waves to a base station, the operational frequency of the antenna section can be set in a wider frequency band placed within the first, second or third specific frequency band, and the radiation direction of the antenna section can be appropriately set.

Further, because the antenna sections 10*a* and 10*c* are concentrically disposed, the radiation elements 15*a* and 15*c* can be compactly placed on the ground plane 13. Accordingly, although the antenna apparatus 10 radiates and receives electromagnetic waves of the first and third specific frequency bands, the size of the ground plane 13 can be made small.

In this embodiment, the second operational frequency of the radiation element 15*b* is lower than the first operational frequency of the radiation element 15*a* and is higher than the third operational frequency of the radiation element 15*c*. However, the operational frequency in each radiation element can be arbitrarily set.

Further, the radiation element 15*b* has the linear antenna 153 extending straight to radiate and receive linearly polarized waves. However, to radiate and receive linearly polarized waves, the radiation element 15*b* may have an antenna turned back to be formed in the Meander line shape. Further, the linear antenna 153 of the radiation element 15*b* is of a resonance type and acts as a standing-wave antenna. However, the radiation element 15*b* may have a traveling-wave antenna of the radiation element 15*a*.

Moreover, the antenna apparatus 10 may have three or more antenna sections concentrically disposed.

Furthermore, in this embodiment, the plates 33*c* are arranged in a single line. However, the plates 33*c* may be arranged in a plurality of lines such that each line of plates 33*c* is disposed so as to surround the first and second antenna sections 10*a* and 10*b*. In the same manner, the plates 33*b* may be arranged in a plurality of lines.

Figure 12:
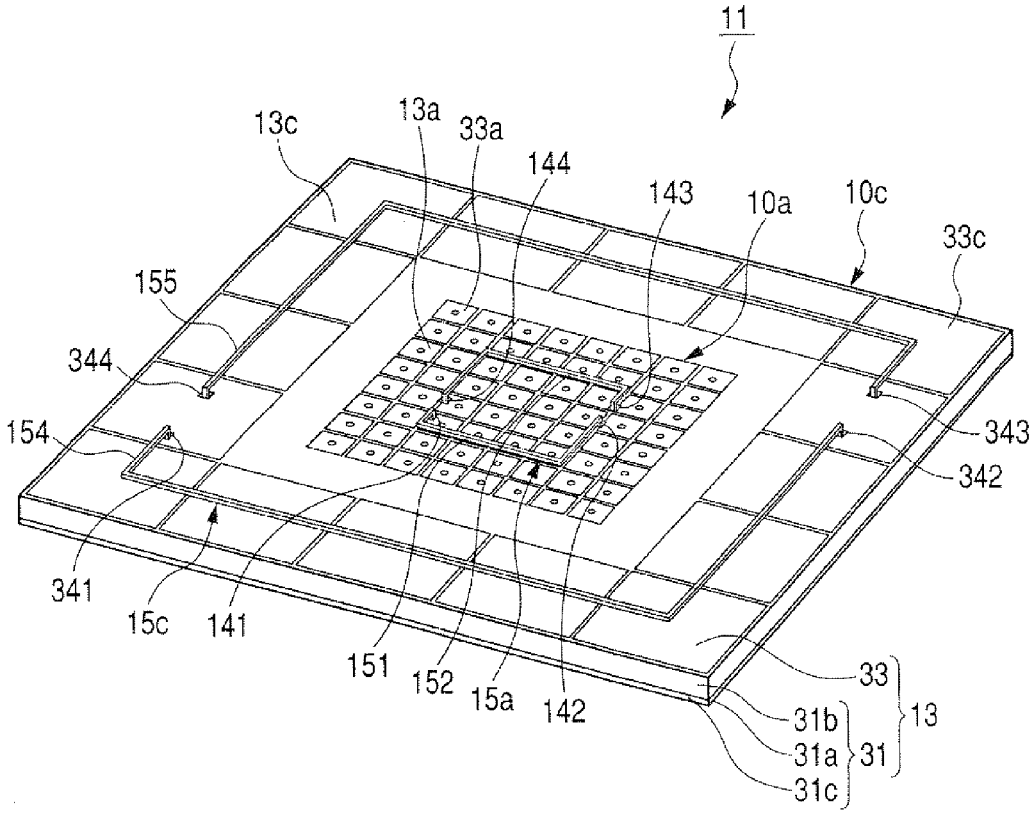
FIG. 12 is a perspective side view of an antenna apparatus according to a first modification of the second embodiment.
Figure 13:
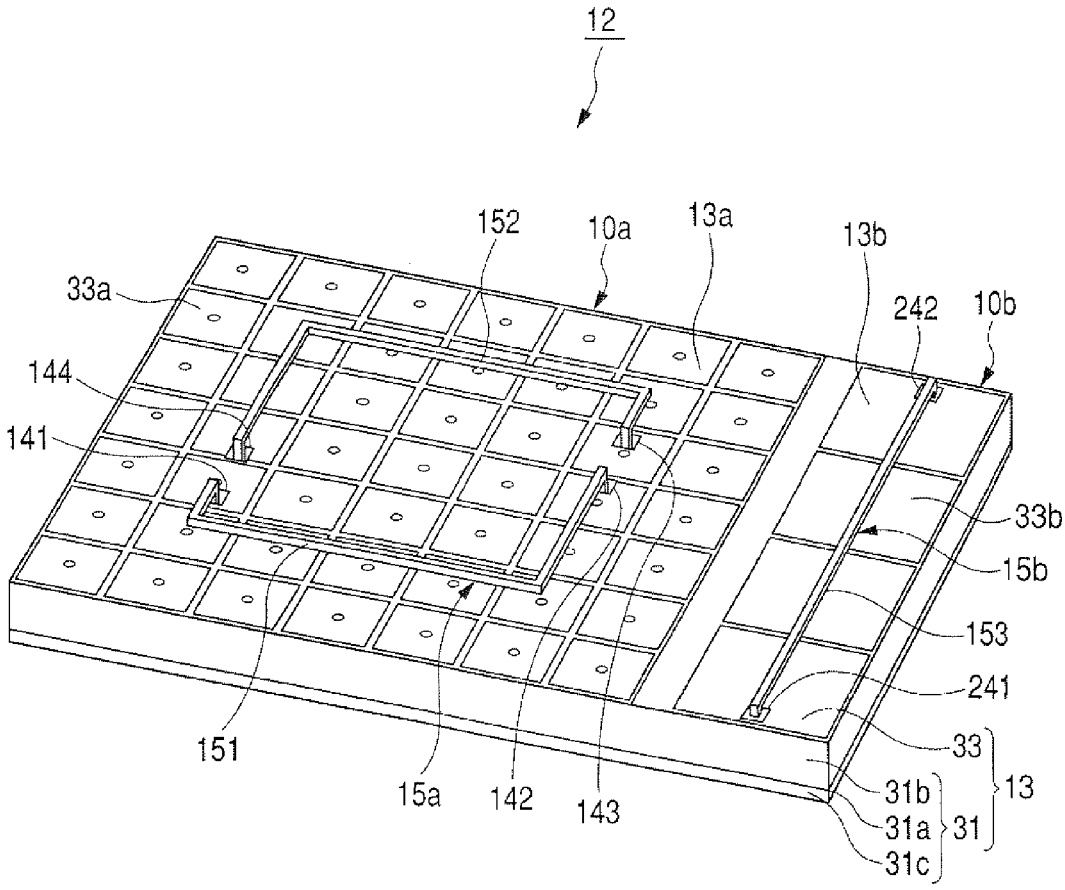
FIG. 13 is a perspective side view of an antenna apparatus according to a second modification of the second embodiment.

The antenna apparatus 10 is not limited to the structure shown in FIG. 7. FIG. 12 is a perspective side view of an antenna apparatus according to a first modification of the second embodiment, while FIG. 13 is a perspective side view of an antenna apparatus according to a second modification of the second embodiment. For example, as shown in FIG. 12, an antenna apparatus 11 may have only the antenna sections 10*a* and 10*c*. As shown in FIG. 13, an antenna apparatus 12 may have only the antenna sections 10*a* and 10*b*.

Embodiment 3

Figure 14:
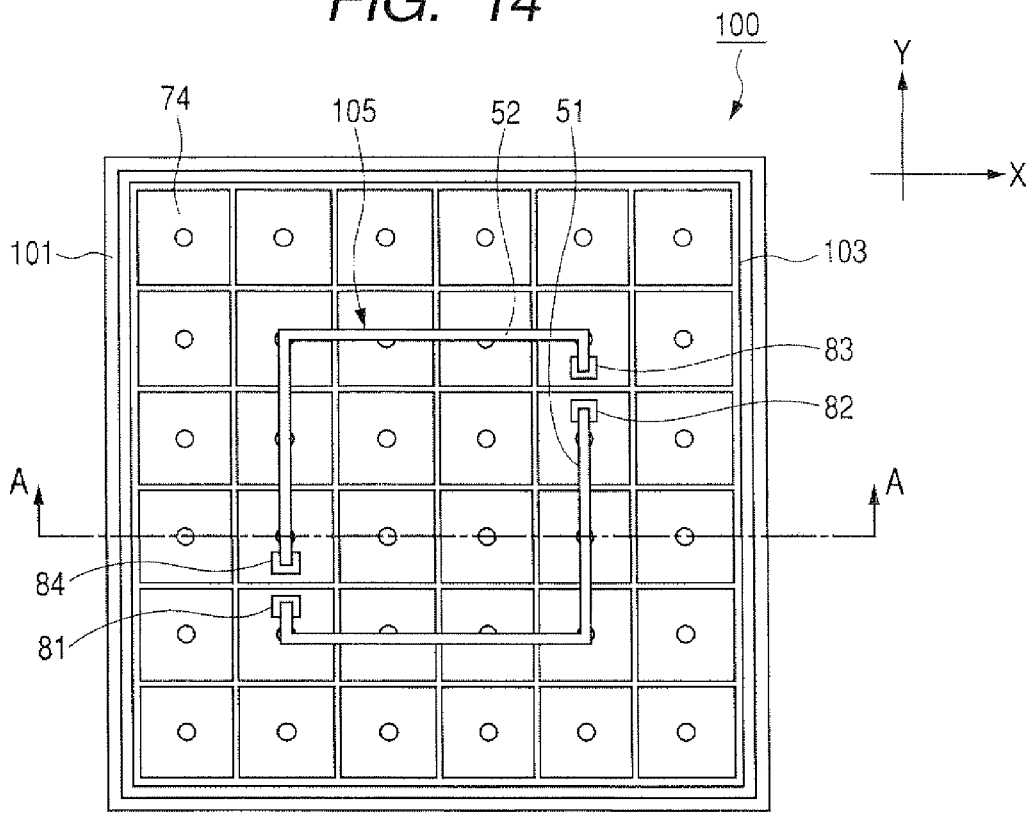
FIG. 14 is a front view of an antenna apparatus according to the third embodiment.
Figure 15:
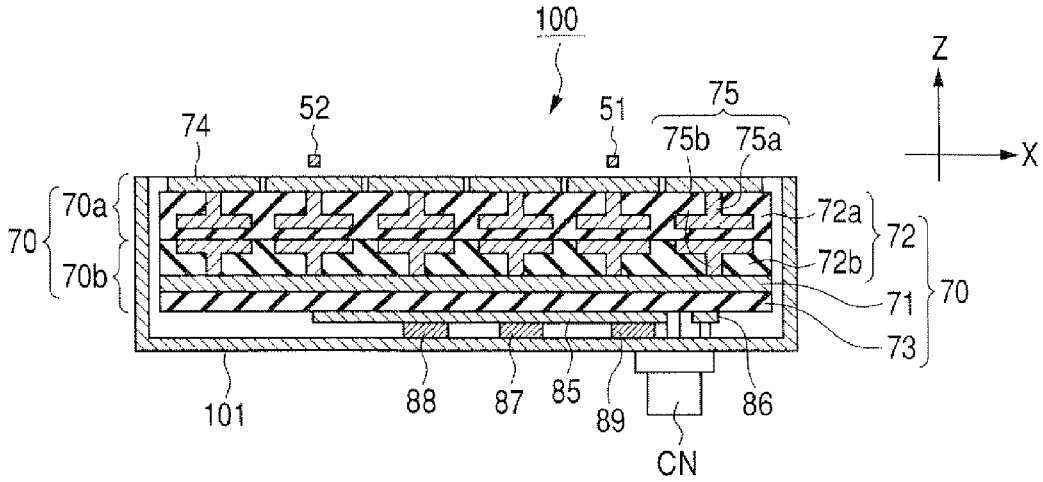
FIG. 15 is a sectional view taken substantially along line A-A of FIG. 14.
Figure 16:
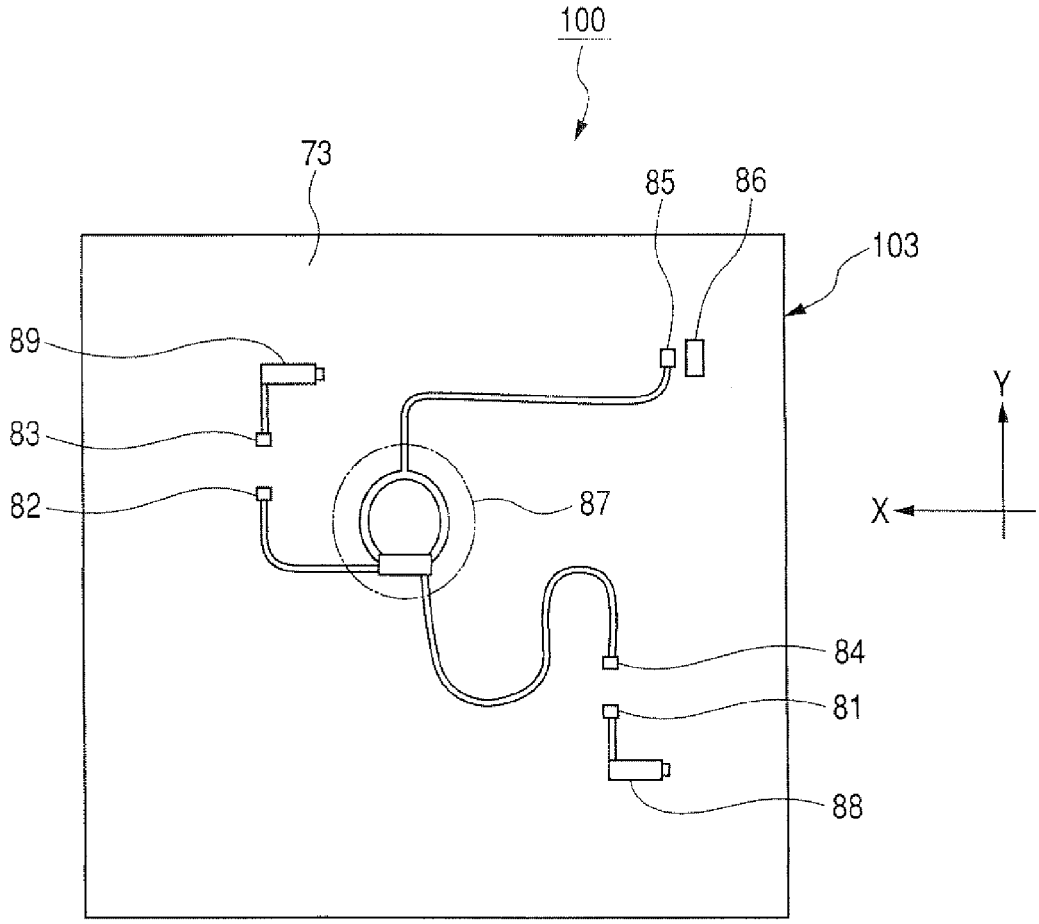
FIG. 16 is a back view of the antenna apparatus shown in FIG. 14.

FIG. 14 is a front view of an antenna apparatus according to the third embodiment, while FIG. 15 is a sectional view taken substantially along line A-A of FIG. 14. FIG. 16 is a back view of the antenna apparatus shown in FIG. 14.

As shown in FIG. 14, FIG. 15 and FIG. 16, an antenna apparatus 100 has a ground plane 103 formed in a rectangular parallelepiped, a radiation element 105 radiating and receiving electromagnetic waves, and an antenna case 101. The case 101 accommodates the ground plane 103 and the radiation element 105 therein so as to surround four side surfaces and a bottom surface of the ground plane 103 and to expose a front surface of the ground plane 103 from an opening of the case 101. The case 101 is made of metal so as to prevent electromagnetic waves from being radiated from the element 105 toward the back side of the apparatus 100 while going around the side surfaces of the ground plane 103. The radiation element 105 has the linear antennas 51 and 52 disposed above the ground plane 103 so as to approximately form a square above the front surface of the ground plane 103. The antennas 51 and 52 are formed and placed in the same manner as those in the first embodiment.

As described later in detail, the ground plane 103 has a band gap surface which is conductive and has a high impedance for an alternating current of a specific frequency band to substantially prevent propagation of electromagnetic waves within the specific frequency band.

The ground plane 103 has a ground plane base portion 70 and a plurality of small metallic plates 74 disposed on the front surface of the portion 70. The base portion 70 has a thinned conductive layer 71 made of metal, a dielectric portion 72 disposed on the upper surface of the layer 71, and a dielectric layer 73 disposed on the lower surface of the layer 71. The plates 74 are formed in the same square shape and are arranged longitudinally and laterally so as to cover the outer surface of the portion 72 while being spaced from one another at equal intervals. The plates 74 are spaced from the antennas 51 and 52 at a constant distance.

The dielectric portion 72 is formed in a two-layered structure. The dielectric portion 72 has a high dielectric constant layer 72*a* having a first relative dielectric constant $\epsilon 1$ and a low dielectric constant layer 72*b* having a second relative dielectric constant $\epsilon 2$ lower than the constant $\epsilon 1$. The upper surface of the layer 72*a* is covered with the plates 74. The layer 72*b* is placed between the layers 72*a* and 71. Therefore, the plates 74 face each other through the layer 72*a* having a high relative dielectric constant $\epsilon 1$, so that the capacitance of a capacitor formed between two adjacent plates 74 in each pair is heightened. Further, each plate 74 faces the layer 71 through the layers 71*a* and 72*b* so as to form a parasitic capacitor between the plate 74 and the layer 71. Because the relative dielectric constant of the layer 72*b* is low, the capacitance of the parasitic capacitor is lowered.

The ground plane 103 further has a plurality of connection members 75 connected with the respective plates 74. The members 75 are made of metal. As is described later in detail, in response to a high frequency current fed to the antennas 51 and 52, each member 75 electrically connects the corresponding plate 74 with the conductive layer 71 through a capacitor. Each member 75 has a first portion 75*a* connected with the corresponding plate 74 and buried into the layer 72*a* and a second portion 75*b* disposed on grooves of the layer 72*b* to be in contact with the layer 72*a*. The first and second portions 75*a* and 75*b* of each member 75 are spaced by a small distance from each other through the layer 72*a* so as to form electrodes opposite to each other. Each member 75 with the first and second portions 75*a* and 75*b* divided by the layer 72*a* forms a capacitor.

Because a high frequency current is supplied to the antennas 51 and 52, each member 75 having a capacitor electrically connects the corresponding plate 74 and the layer 71. Further, because the first and second portions 75*a* and 75*b* of each member 75 are closely placed through the layer 72*a* having a high relative dielectric constant, the capacitance of the capacitor formed by the member 75 is high. Therefore, the capacitor is useful to adjust the impedance in the current path electrically connecting two adjacent metallic plates 33 in each pair. The area of the electrode of each member 75 is, for example, smaller than half of the area of the plate 74 to be sufficiently smaller than the plate 74.

The base portion 70 is partitioned into a first block 70*a* and a second block 70*b*. The layer 72*a* and the first portions 75*a* of the members 75 are placed in the block 70*a*. The layers 71 and 72*b*, the layer 73 and the second portions 75*b* of the members 75 are placed in the block 70*b*. The ground plane 100 is produced by attaching the block 70*a* with the plates 74 and the second block 70*b* to each other. The portion 75*a* of each member 75 is integrally formed with the corresponding plate 74. The portions 75*b* of the members 75 are integrally formed with the layer 73. Therefore, the production of the base portion 70 can be simplified.

To form the surface of the plates 74 as a band gap surface which has a high impedance for an alternating current of a specific frequency band, the ground plane 103 has a specific equivalent circuit of conductors and inductors. That is, the relative dielectric constants and thickness in each of the layers 72*a* and 72*b*, the number of plates 74, the size of each plate 74, the space width between the plates 74 and the capacitance of the capacitor formed in each member 75 are appropriately set.

The ground plane 103 has four attaching holes 81, 82, 83 and 84 penetrating through the base portion 70 and four plates 74, and four end portions (not shown) of the antennas 51 and 52 are inserted into the holes 81 to 84 such that no end portions come in contact with the layer 71 or the plates 74. The ground plane 103 further has two electrodes or terminals 85 and 86 attached to the outer surface of the layer 73 as feed points. A coaxial connector CN is attached to the bottom wall of the case 101. A central conductor of the connector CN is connected with the electrode 85 to feed a high frequency current to the electrode 85, and an external conductor of the connector CN is connected with the end portion of the hole 86. A Wilkinson distributor 87 is attached to the outer surface of the layer 73 to distribute a high frequency current fed to the electrode 85 to the antennas 51 and 52 through the end portions of the holes 82 and 84. The distributor 87 is connected with each of the electrode 85 and the end portions of the holes 82 and 84 through a microstrip line.

The radiation element 105 further has two terminating loads 88 and 89 connected with the end portions of the holes 81 and 83 on the outer surface of the layer 73 to terminate the antennas 51 and 52. Therefore, a high frequency current fed from the connector CN to the electrode 85 is distributed in the distributor 87 to be transmitted to the antennas 51 and 52 in parallel to each other. Because the antennas 51 and 52 are terminated by the terminating loads 88 and 89, no standing waves are substantially produced in the antennas 51 and 52. Therefore, the antennas 51 and 52 receiving the high frequency current in parallel to each other act as a traveling-wave antenna.

The length of the line between the distributor 87 and each of the end portions of the holes 82 and 84 is set such that each of the antennas 51 and 52 radiates circularly polarized waves.

As is described above, the antenna apparatus 100 has the ground plane 103 having the band gap surface on the front side of the ground plane 103 and the traveling-wave linear antennas 51 and 52 disposed over the band gap surface on the front side of the ground plane 103 to be spaced away from the band gap surface. The band gap surface is conductive and has a high impedance for an alternating current of the specific frequency band to substantially prevent propagation of electromagnetic waves set within the specific frequency band. That is, the antennas 51 and 52 are disposed over the high impedance ground plane 103 having the electromagnetic band gap (EBG) structure.

Accordingly, in the same manner as in the first embodiment, the antenna apparatus 100 can have a low profile so as to be set in a small size.

Further, when it is intended to thin an antenna apparatus with a ground plane, a block of metallic plates are placed close to a conductive plate through a dielectric layer in the ground plane. Therefore, a parasitic capacitor is undesirably formed in the dielectric layer placed between each metallic plate and the conductive layer. The parasitic capacitor considerably influences on the impedance in a current path connecting two adjacent metallic plate through a connection member. Therefore, it is difficult to precisely adjust the impedance in the ground plane and to have a high impedance ground plane having a high impedance for a specific frequency band. In contrast, in this embodiment, the antenna apparatus 100 has the layers 72*a* and 72*b*. Because the ground plane 103 has the layer 72*a* having a higher relative dielectric constant, the capacitor formed between two adjacent plates 74 in each pair can have a sufficiently high capacitance. Because the ground plane 103 has the layer 72*b* having a lower relative dielectric constant, the capacitance of a parasitic capacitor in the layers 72*a* and 72*b* placed between each plate 74 and the layer 71 can be made small. Accordingly, the base portion 70 can be sufficiently thinned so as to manufacture a small-sized antenna apparatus.

Moreover, in addition to the low profile of the antenna apparatus 100, the antenna apparatus 100 has the metallic case 101 accommodating the ground plane 103 therein. Therefore, the antenna apparatus 100 can further reduce the radiation of electromagnetic waves in the back direction, so that the antennas 51 and 52 substantially receive no adverse influence from objects placed on the back side of the antenna apparatus 100. Accordingly, the antenna apparatus 100 can radio-communicate with the station with higher precision.

Furthermore, in the first embodiment, the antennas 51 and 52 are serially arranged with respect to the feed point 61 (see FIG. 4), so that a high frequency current flows through a series of antennas 51 and 52. Because a part of the current is changed to electromagnetic waves in the antenna 51, the current value in the antenna 51 is higher than that in the antenna 52. Therefore, the strength of waves radiated from the antenna 51 becomes larger than that radiated from the antenna 52, and it is sometimes difficult to adjust the wave strength in the antenna 51 and the wave strength in the antenna 52. In contrast, in the third embodiment, the antennas 51 and 52 are arranged in parallel to each other with respect to the feed point 85. Therefore, the current fed to each of the antennas 51 and 52 through the distributor 87 can be appropriately set. Accordingly, the antenna apparatus 100 can radiate desired circularly polarized waves (e.g., waves of right-handed polarization) while sufficiently suppressing the production of unnecessary circularly polarized waves (e.g., waves of left-handed polarization).

Figure 17A:
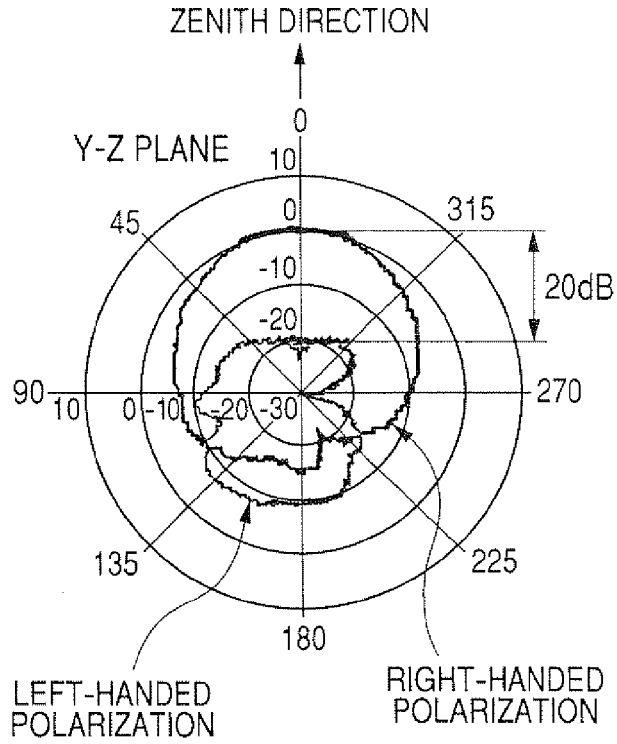
FIG. 17A shows radiation characteristics of the antenna apparatus shown in FIG. 14 in a Y-Z plane.
Figure 17B:
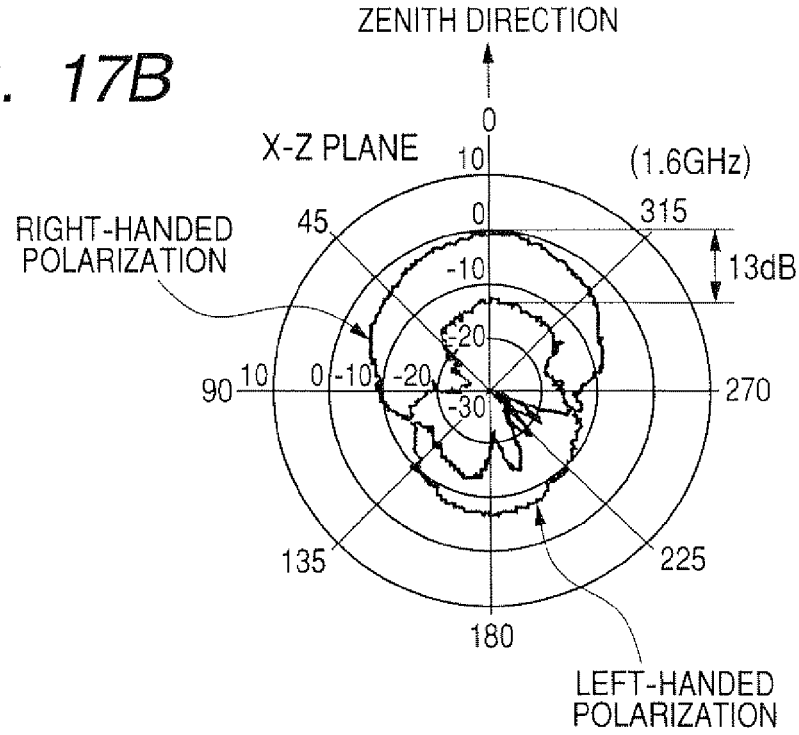
FIG. 17B shows radiation characteristics of the antenna apparatus shown in FIG. 14 in an X-Z plane.

The intensity of right-handed circularly polarized waves in comparison with the intensity of left-handed circularly polarized waves is shown in FIG. 17A and FIG. 17B. FIG. 17A shows radiation characteristics of the antenna apparatus 100 in an Y-Z plane, while FIG. 17B shows radiation characteristics of the antenna apparatus 100 in an X-Z plane. The direction normal to the band gap surface (i.e., surface of metallic plates 74) is defined as the Z axis. One extending direction of the antennas 51 and 52 is defined as the X axis. Another extending direction of the antennas 51 and 52 is defined as the Y axis. The plane defined by the Y and Z axes is called a Y-Z plane. The plane defined by the X and Z axes is called an X-Z plane. The direction corresponding to 0 angle is the zenith direction.

The size of the ground plane 103 is 60 mm×60 mm in the X-Y plane. The high dielectric constant layer 72*a* is formed of resin and has the thickness of 0.5 mm and the relative dielectric constant equal to 7. The low dielectric constant layer 72*b* is formed of glass epoxy resin and has the thickness of 1.5 mm and the relative dielectric constant equal to 4. The dielectric layer 73 is formed of glass epoxy resin and has the thickness of 0.5 mm and the relative dielectric constant equal to 4. The operational frequency of the high impedance ground plane (i.e., ground plane 103) is equal to 1.6 GHz. Each side of the square formed by the antennas 51 and 52 has the length of approximately 10 mm.

As shown in FIG. 17A and FIG. 17B, it will be realized that the antenna apparatus 100 radiates right-handed circularly polarized waves while sufficiently suppressing the production of left-handed circularly polarized waves.

In this embodiment, each of the antennas 51 and 52 extends over a line which connects center positions of respective metallic plates 74. However, each of the antennas 51 and 52 may extend over openings formed among metallic plates 74 in the same manner as the antenna apparatus la shown in FIG. 6.

Further, in this embodiment, the distributor 87 is connected with the electrode 85 and the end portions of the holes 82 and 84 through microstrip lines. However, the distributor 87 may be connected with the electrode 85 and the end portions of the holes 82 and 84 through strip lines or transmission lines.

Embodiment 4

Figure 18:
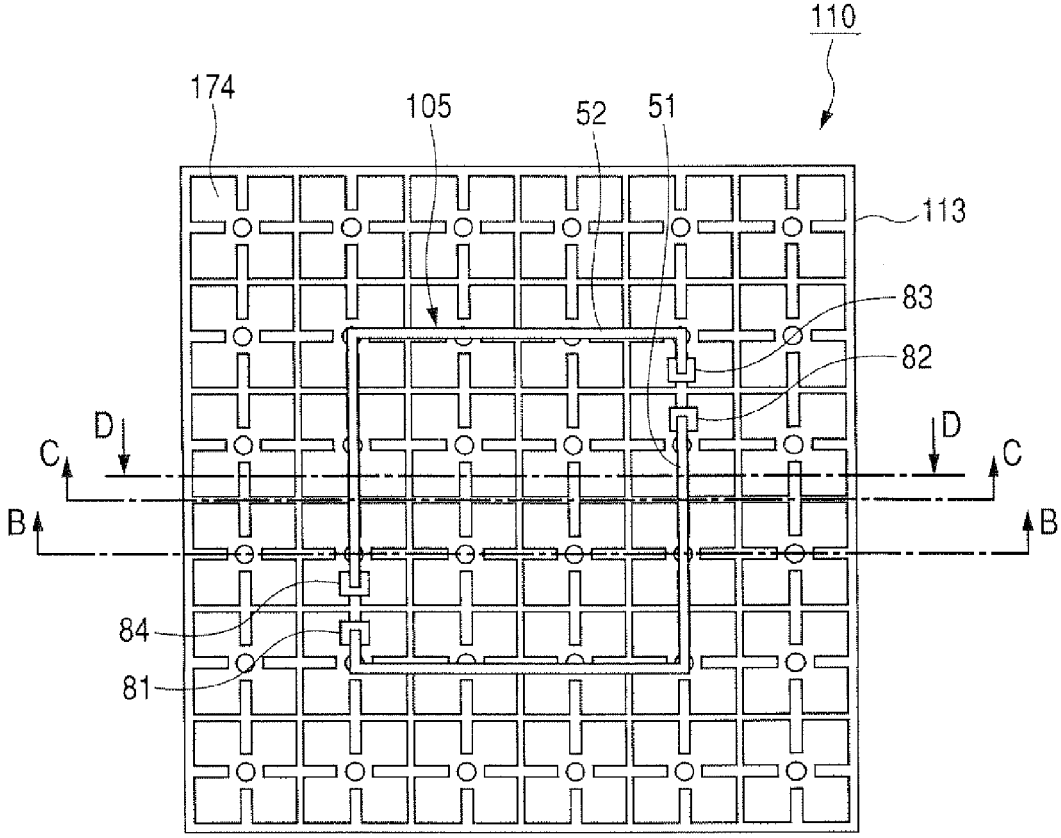
FIG. 18 is a front view of an antenna apparatus according to the fourth embodiment.
Figure 19:
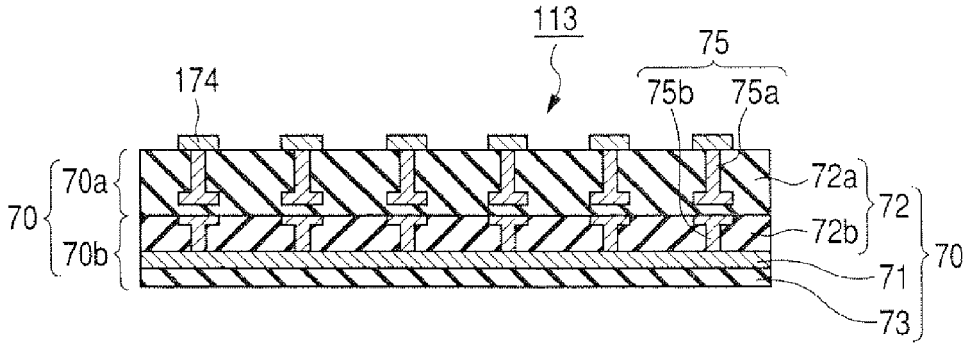
FIG. 19 is a sectional view taken substantially along line B-B of FIG. 18 while excluding a radiation element.
Figure 20:
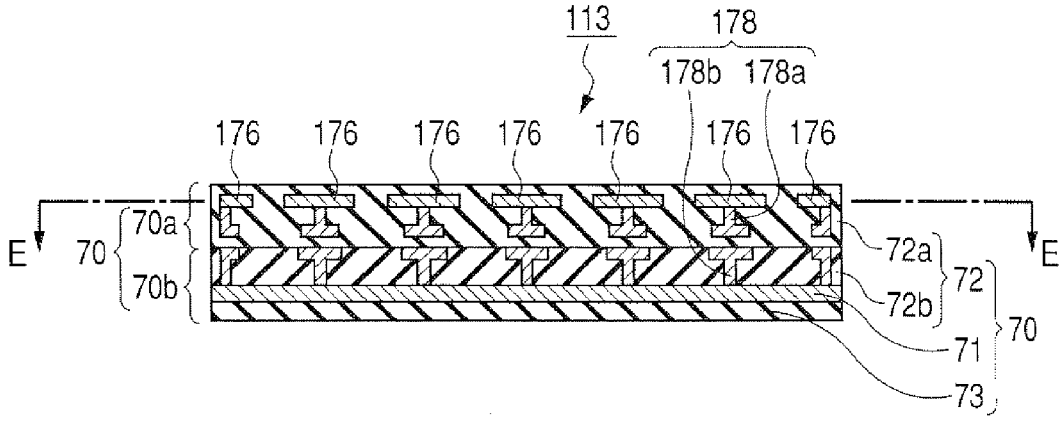
FIG. 20 is a sectional view taken substantially along line C-C of FIG. 18 while excluding a radiation element.
Figure 21:
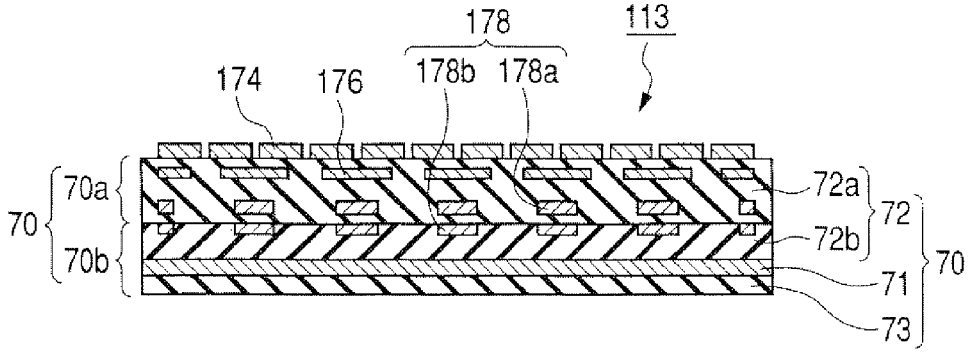
FIG. 21 is a sectional view taken substantially along line D-D of FIG. 18 while excluding a radiation element.
Figure 22:
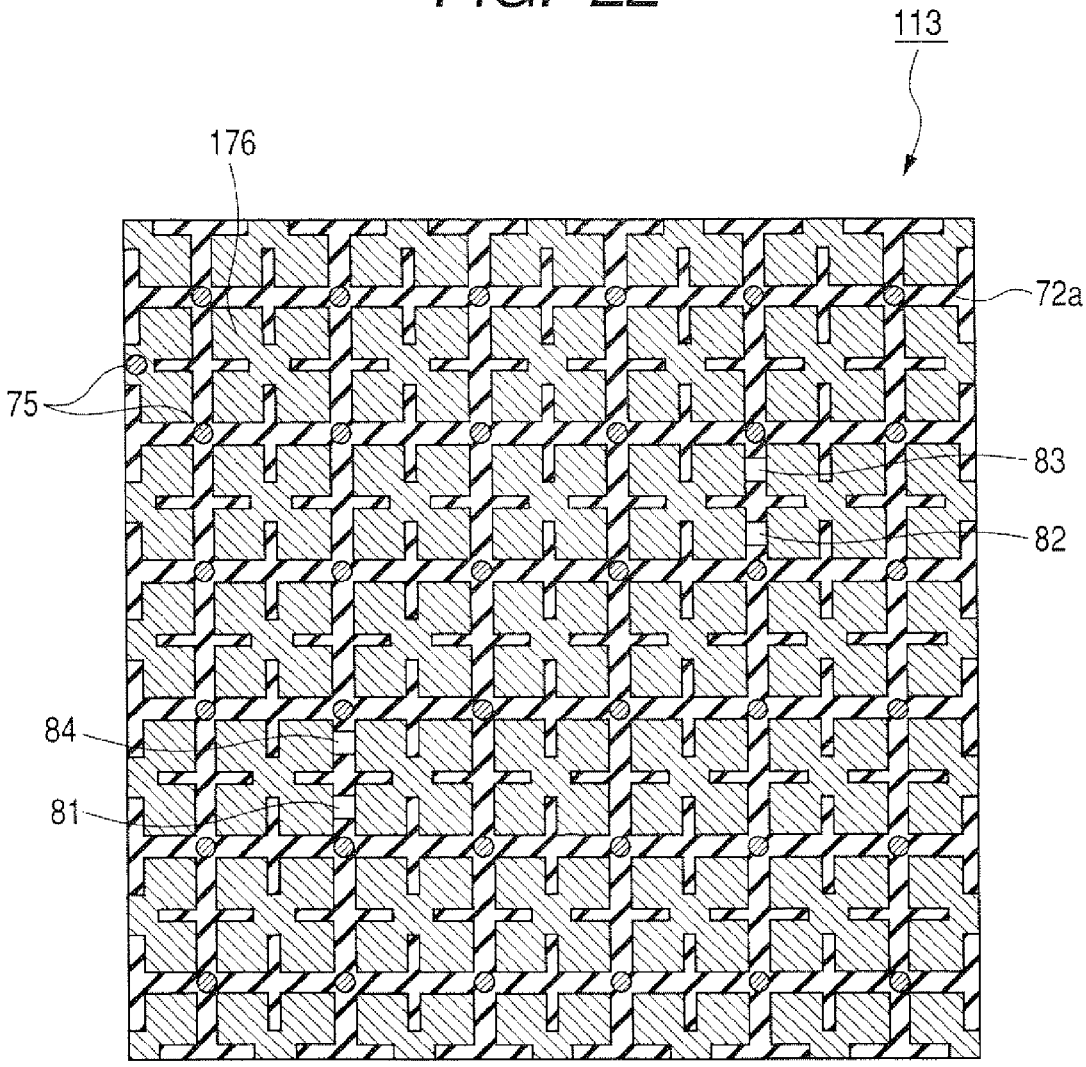
FIG. 22 is a sectional view taken substantially along line E-E of FIG. 20.

FIG. 18 is a front view of an antenna apparatus according to the fourth embodiment. FIG. 19 is a sectional view taken substantially along line B-B of FIG. 18 while excluding a radiation element, FIG. 20 is a sectional view taken substantially along line C-C of FIG. 18 while excluding a radiation element, and FIG. 21 is a sectional view taken substantially along line D-D of FIG. 18 while excluding a radiation element. FIG. 22 is a sectional view taken substantially along line E-E of FIG. 20.

As shown in FIG. 18, FIG. 19, FIG. 20 and FIG. 21, an antenna apparatus 110 has a ground plane 113 formed in a rectangular parallelepiped and the radiation element 105. The radiation element 105 has the linear antennas 51 and 52 disposed above the ground plane 113 so as to approximately form a square above the front surface of the ground plane 113. As described later in detail, the ground plane 113 has a band gap surface which is conductive and has a high impedance for an alternating current of a specific frequency band to substantially prevent propagation of electromagnetic waves set within the specific frequency band.

The ground plane 113 has the ground plane base portion 70, a plurality of first small metallic plates 174 disposed on the front surface of the portion 70, and the connection members 75 connected with the respective plates 174. In the same manner as in the third embodiment, each connection member 75 has the first and second portions 75*a* and 75*b* and electrically connects the corresponding plate 174 with the conductive layer 71 through a capacitor. The portion 75*a* of each member 75 is integrally formed with the corresponding plate 174.

Each plate 174 is formed approximately in a square. A slit is formed in the center of each side of the square such that the slit extends toward the center of the square. Therefore, the plate 174 has four small square portions. The plates 174 are arranged longitudinally and laterally on the layer 72*a* of the dielectric portion 72 while being spaced from one another at equal intervals Four slits of each plate 174 face respective slits of four adjacent plates 174. Therefore, the plates 174 face one another through the layer 72*a* so as to heighten the capacitance of a capacitor formed between two adjacent plates 174 in each pair. Further, each plate 174 faces the layer 71 through the layers 71*a* and 72*b* so as to form a parasitic capacitor between the plate 174 and the layer 71. Because the relative dielectric constant of the layer 72*b* is low, the capacitance of the parasitic capacitor is lowered. The plates 174 are spaced from the antennas 51 and 52 at a constant distance.

As shown in FIG. 20 and FIG. 21, the ground plane 113 further has a plurality of second small metallic plates 176 and a plurality of second connection members 178. The members 178 are made of metal. The members 178 electrically connect the respective plates 176 and the layer 71 through capacitors.

Each plate 176 has substantially the same shape as that of the plate 174. The plates 176 are buried into the layer 72*a* and are arranged longitudinally and laterally while being spaced from one another at equal intervals. Therefore, the block of plates 176 is spaced from the block of plates 174 by a constant distance. The center positions of the plates 176 are shifted from the center positions of the plates 174 such that four small square portions of each plate 174 face respective small square portions of four plates 176 adjacent to the plate 174 through the layer 72*a*. Therefore, a capacitor is formed between each portion of the plates 174 and the corresponding portion of one plate 176, and the capacitance of the capacitor is high because of the high relative dielectric constant of the layer 72*a* placed between the portions of the plates 174 and 175.

Each member 178 has a first portion 178*a* connected with the corresponding plate 176 and a second portion 178*b* connected with the layer 71. The first portions 178*a* are buried into the layer 72*a*. The second portions 178*b* are placed on grooves of the layer 72*b* to be exposed to the layer 72*a*. The portions 178*a* and 178*b* have electrodes in the same manner as those of the portions 75*a* and 75*b*. Therefore, the portions 178*a* and 178*b* of each member 178 face each other at a short distance through the layer 72*a* having the high relative dielectric constant, so that a capacitor is formed between each plate 176 and the layer 71.

To form the surface of the plates 174 as a band gap surface which has a high impedance for an alternating current of a specific frequency band, the ground plane 113 has a specific equivalent circuit of conductors and inductors. That is, the capacitance of a capacitor produced between each plate 176 and the layer 71 facing each other through the connection member 178 and the layer 72*a* is appropriately set in addition to the relative dielectric constants and thickness in each of the layers 72*a* and 72*b*, the number of plates 174, the size of each plate 174, the space width between the plates 174, and the capacitance of the capacitor formed between each member 175 and the layer 71 facing each other through the layer 72*a* and the connection member 75.

As is described above, in this embodiment, the antenna apparatus 110 has the plates 176 and the connection members 178. Therefore, as compared with the antenna apparatus 100 in the third embodiment, the capacitance of a capacitor produced between each plate 176 and the layer 71 can be additionally adjusted to form the surface of the plates 174 as the band gap surface Accordingly, the operational frequency can be set with high precision, and the operational frequency can be set to be lower than that in the antenna apparatus 100.

Modifications

Figure 23:
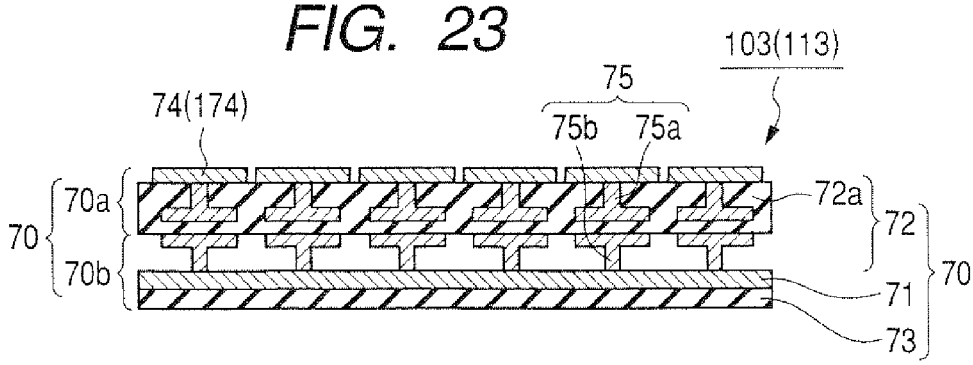
FIG. 23 is a sectional view partially showing a ground plane according to a first modification of the third and fourth embodiments.

FIG. 23 is a sectional view partially showing the ground plane 103 or 113 according to a first modification of the third and fourth embodiments.

As shown in FIG. 23, the dielectric portion 72 may have only the high dielectric constant layer 72*a*. That is, openings having a relative dielectric constant lower than that of the layer 72*b* are formed between the layers 72*a* and 71. With this structure, although a parasitic capacitor is formed in the opening and the layer 72*a* between each plate 74 or 174 and the layer 71, the capacitance of the parasitic capacitor can be set at a sufficiently low value.

Figure 24:
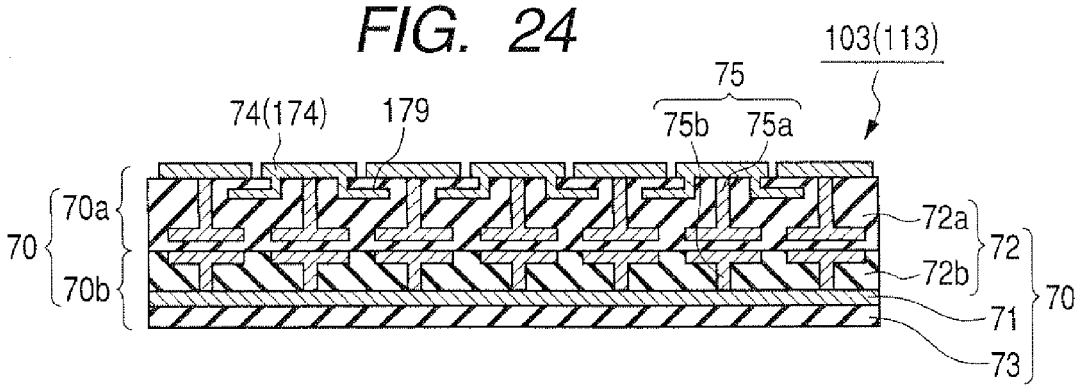
FIG. 24 is a sectional view partially showing a ground plane according to a second modification of the third and fourth embodiments.

FIG. 24 is a sectional view partially showing the ground plane 103 or 113 according to a second modification of the third and fourth embodiments.

As shown in FIG. 24, one of two adjacent metallic plates 74 or 174 in each pair may have an arm 179 which is buried into the layer 72*a* and extends toward the adjacent metallic plate 74 or 174 to face the adjacent metallic plate 74 or 174 through the layer 72*a*. With this structure, a capacitor is additionally produced between each arm 179 of one plate 74 or 174 and one adjacent metallic plate 74 or 174. Accordingly, the impedance of the ground plane 103 or 113 can be further precisely adjusted to set the ground plane 103 or 113 to a high impedance ground plane.

Figure 25:
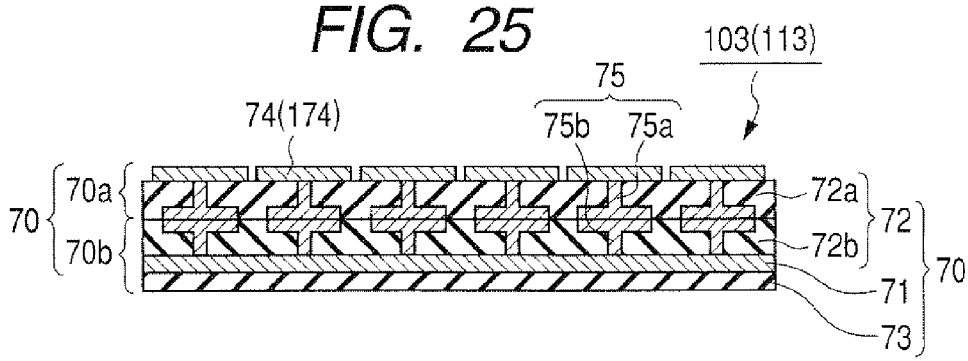
FIG. 25 is a sectional view partially showing a ground plane according to a third modification of the third and fourth embodiments.

FIG. 25 is a sectional view partially showing the ground plane 103 or 113 according to a third modification of the third and fourth embodiments.

As shown in FIG. 25, the second portions 75*b* of the connection members 75 disposed into the layer 72*b* may be exposed to the layer 72*a*. With this structure, the first and second portions 75*b* of each connection member 75 are in contact with each other. Therefore, although no capacitor for adjusting the impedance of the ground plane 103 or 113 is formed, the plates 74, the connection member 75 and the layer 71 can be integrally formed one another. Accordingly, the ground plane 103 or 113 can be easily formed.

Figure 26:
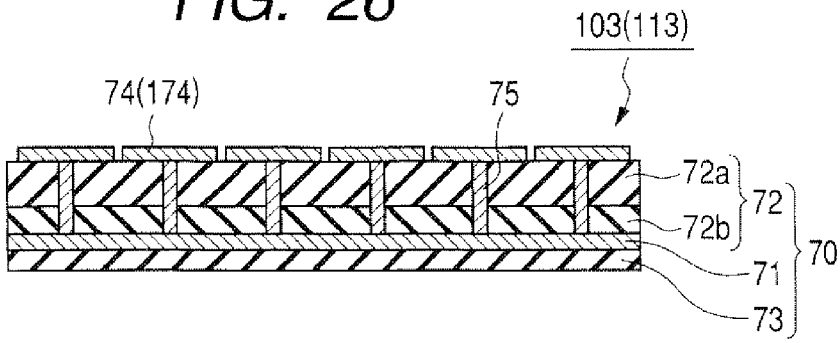
FIG. 26 is a sectional view partially showing a ground plane according to a fourth modification of the third and fourth embodiments.

FIG. 26 is a sectional view partially showing the ground plane 103 or 113 according to a fourth modification of the third and fourth embodiments.

As shown in FIG. 26, the connection members 75 may have no electrodes while each connection member 75 mechanically or directly connects the corresponding plate 74 and the layer 71. With this structure, to form the ground plane 103 or 113, it is not required to attach a first block including the layer 72*a* and a second block including the layer 72*b* to each other. For example, the ground plane 103 or 113 is formed by depositing the layer 73, the layer 71, the layer 72*b*, the layer 72*a*, and the combination of the plates 74 or 174 and the connection members 75 in that order. Accordingly, the ground plane 103 or 113 can be easily formed.

The thickness of the layer 72*a* is larger than that of the layer 72*b*. Therefore, although a parasitic capacitor is formed in the layers 72*a* and 72*b* placed between each plate 74 or 174 and the layer 71, the influence of the parasitic capacitor on the impedance of the ground plane 103 or 113 can be reduced.

Figure 27:
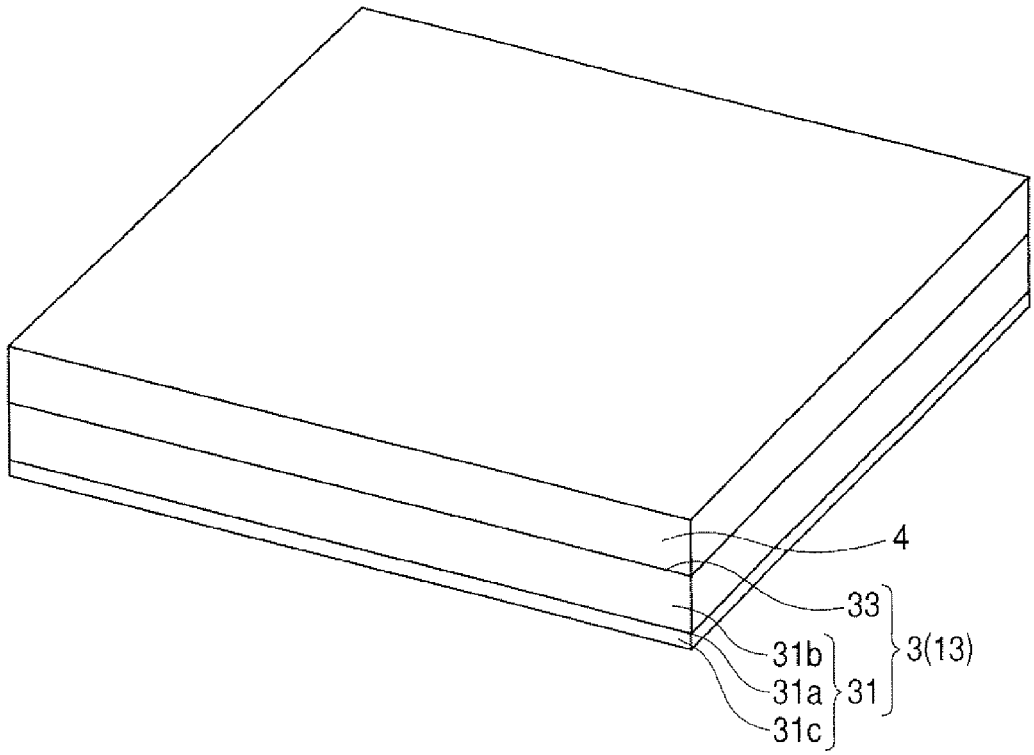
FIG. 27 is a perspective side view of an antenna apparatus according to a modification of the first to fourth embodiments.

FIG. 27 is a perspective side view of an antenna apparatus according to a modification of the first to fourth embodiments.

In the first to fourth embodiments, the antennas of the antenna apparatuses 1, 10, 11, 12, 100 and 110 are exposed to the outside. However, as shown in FIG. 27, an antenna apparatus 120 may have a radiation element (not shown) such as radiation element 5, 15*a*, 15*b*, 15*c* or 105, the ground plane 3, 13, 103 or 113, and a dielectric layer 4 covering the radiation element and the ground plane 3, 13, 103 or 113. The dielectric layer 4 has a high relative dielectric constant.

With this structure, the dielectric layer 4 shortens the wavelength of electromagnetic waves radiated from the radiation element. Therefore, when the antenna apparatus 120 radiates electromagnetic waves set at the same wavelength as that of electromagnetic waves radiated from a comparative antenna apparatus with a radiation element exposed to the outside, the radiation element of the antenna apparatus 120 can be downsized as compared with the radiation element of the comparative antenna apparatus. Accordingly, the antenna apparatus 120 can be downsized.

Further, in the first to fourth embodiments, the antennas 51, 52, 151, 152, 153, 154 and 155 are disposed to be spaced from the band gap surface (i.e., surface of the metallic plates 33, 33*a*, 33*b*, 33*c*, 74 or 174) of the ground plane 3, 13, 103 or 113. However, the ground plane 3, 13, 103 or 113 may be covered with an insulating dielectric layer so as to dispose the antennas on the insulating dielectric layer. With this structure, the distance between the antennas and the ground plane 3, 13, 103 or 113 can be shortened. Accordingly, the antenna apparatus can be further thinned.

Moreover, in the same manner as in the third embodiment, the antennas of the radiation element 5, 15*a*, 15*c* or 105 in the first, second or fourth embodiment may be arranged in parallel to each other with respect to a feed point.

These embodiments should not be construed as limiting the present invention to structures of those embodiments, and the structure of this invention may be combined with that based on the prior art.

What is claimed is:

1. An antenna apparatus comprising:

a ground plane having a band gap surface on a first side of the ground plane such that the band gap surface is conductive and substantially prevents propagation of electromagnetic waves set within a specific frequency band; and a traveling-wave linear antenna, disposed over the band gap surface on the first side of the ground plane and spaced away from the band gap surface, which linear antenna radiates electromagnetic waves of an operational frequency placed within the specific frequency band in response to an alternating current of the operational frequency inputted to the linear antenna to output a communication signal contained in the alternating current, wherein the linear antenna has a first center portion extending straight in a first direction, a first side portion extending straight from an end of the first central portion substantially at an angle of 90 degrees to the first direction and a second side portion extending straight from another end of the first central portion substantially at an angle of 90 degrees to the first direction so as to be substantially formed in a U shape and to radiate circularly polarized electromagnetic waves.

2. The antenna apparatus according to claim 1, wherein the linear antenna further has a second center portion extending straight in the first direction, a third side portion extending straight from an end of the second central portion substantially at an angle of 90 degrees to the first direction toward the first side portion and a fourth side portion extending straight from another end of the second central portion substantially at an angle of 90 degrees to the first direction toward the second side portion so as to substantially form four sides of a square and symmetric in rotation of 180 degrees with respect to a center of the linear antenna when rotated on a plane parallel to the ground plane.

3. The antenna apparatus according to claim 1, wherein the ground plane comprises:

a conductive layer;

a first dielectric layer disposed on a first surface of the conductive layer;

a second dielectric layer disposed on a second surface of the conductive layer opposite to the first surface;

a plurality of first metallic plates disposed on the first dielectric layer; and a plurality of first connection portions electrically connecting the respective metallic plates and the conductive layer, wherein a surface of the first metallic plates faces the linear antenna and acts as the band gap surface.

4. The antenna apparatus according to claim 1, further comprising:

an insulating dielectric layer covering the linear antenna and the ground plane.

5. The antenna apparatus according to claim 1, further comprising:

an antenna case, made of metal, which accommodates the ground plane so as to expose the band gap surface of the ground plane from an opening of the antenna case.

6. The antenna apparatus according to claim 2, wherein the first and second center portions of the liner antenna have substantially the same length, the first and fourth side portions of the linear antenna have substantially the same length, and the second and third side portions of the linear antenna have substantially the same length which is longer than the length of the first and fourth side portions.

7. An antenna apparatus comprising:

a ground plane having a band gap surface on a first side of the ground plane such that the band gap surface is conductive and substantially prevents propagation of electromagnetic waves set within a specific frequency band; and a traveling-wave linear antenna, disposed over the band gap surface on the first side of the ground plane and spaced away from the band gap surface, which linear antenna radiates electromagnetic waves of an operational frequency placed within the specific frequency band in response to an alternating current of the operational frequency inputted to the linear antenna to output a communication signal contained in the alternating current, wherein the band gap surface of the ground plane has a plurality of partitioned band gap surfaces corresponding to respective specific frequency bands differentiated from one another, the linear antenna has a plurality of partitioned linear antennas disposed over the respective partitioned band gap surfaces, and each partitioned linear antenna is adapted to radiate electromagnetic waves placed within the specific frequency band of the corresponding partitioned band gap surface.

8. The antenna apparatus according to claim 7, wherein at least two of the partitioned linear antennas are concentrically placed.

9. An antenna apparatus comprising:

a ground plane having a band gap surface on a first side of the ground plane such that the band gap surface is conductive and substantially prevents propagation of electromagnetic waves set within a specific frequency band; and a traveling-wave linear antenna, disposed over the band gap surface on the first side of the ground plane and spaced away from the band gap surface, which linear antenna radiates electromagnetic waves of an operational frequency placed within the specific frequency band in response to an alternating current of the operational frequency inputted to the linear antenna to output a communication signal contained in the alternating current, wherein the ground plane comprises:

a conductive layer;

a first dielectric layer disposed on a first surface of the conductive layer;

a second dielectric layer disposed on a second surface of the conductive layer opposite to the first surface;

a plurality of first metallic plates disposed on the first dielectric layer; and a plurality of first connection portions electrically connecting the respective metallic plates and the conductive layer, wherein a surface of the first metallic plates faces the linear antenna and acts as the band gap surface, and wherein the first dielectric layer placed between the block of first metallic plates and the conductive layer has both a first dielectric constant layer facing the metallic plates and having a first relative dielectric constant and a second dielectric constant layer facing the conductive layer and having a second relative dielectric constant lower than the first relative dielectric constant.

10. The antenna apparatus according to claim 9, wherein the ground plane further comprises:

a plurality of second metallic plates disposed into the first dielectric constant layer such that each second metallic plate faces at least two of the first metallic plates through the first dielectric constant layer in a thickness direction of the ground plane having the layers disposed along the thickness direction; and a plurality of second connection portions electrically connecting the respective second metallic plates and the conductive layer.

11. The antenna apparatus according to claim 9, wherein the ground plane is partitioned into a first regional portion composed of the first dielectric constant layer and first portions of the first connection portions disposed in the first dielectric constant layer and a second regional portion composed of the second dielectric constant layer, second portions of the first connection portions disposed in the second dielectric constant layer, the conductive layer and the second dielectric layer, the first portion of each first connection portion has an electrode placed to be opposite to the corresponding first metallic plate, the second portion of each first connection portion has an electrode placed to be opposite to the conductive layer, and the ground plane is obtained by attaching the first regional portion with the first metallic plates and the second regional portion to each other such that the electrodes of each first connection portion face each other.

12. The antenna apparatus according to claim 11, wherein the electrode of the first portion of each first connection portion is disposed into the first dielectric constant layer so as to face the electrode of the second portion of the first connection portion through the first dielectric constant layer.

13. An antenna apparatus comprising:

a ground plane having a band gap surface on a first side of the ground plane such that the band gap surface is conductive and substantially prevents propagation of electromagnetic waves set within a specific frequency band; and a traveling-wave linear antenna, disposed over the band gap surface on the first side of the ground plane and spaced away from the band gap surface, which linear antenna radiates electromagnetic waves of an operational frequency placed within the specific frequency band in response to an alternating current of the operational frequency inputted to the linear antenna to output a communication signal contained in the alternating current, wherein the ground plane comprises:

a conductive layer;

a first dielectric layer disposed on a first surface of the conductive layer;

a second dielectric layer disposed on a second surface of the conductive layer opposite to the first surface;

a plurality of first metallic plates disposed on the first dielectric layer; and a plurality of first connection portions electrically connecting the respective metallic plates and the conductive layer, wherein a surface of the first metallic plates faces the linear antenna and acts as the band qap surface, and wherein the transmission line is disposed on a surface of the second dielectric layer opposite to a side of the conductive layer.

14. An antenna apparatus comprising:

a ground plane having a band qap surface on a first side of the ground plane such that the band gap surface is conductive and substantially prevents propagation of electromagnetic waves set within a specific frequency band; and a traveling-wave linear antenna, disposed over the band gap surface on the first side of the ground plane and spaced away from the band gap surface, which linear antenna radiates electromagnetic waves of an operational frequency placed within the specific frequency band in response to an alternating current of the operational frequency inputted to the linear antenna to output a communication signal contained in the alternating current, wherein the ground plane comprises:

a conductive layer;

a plurality of metallic plates;

a plurality of connection portions electrically connecting the respective metallic plates and the conductive layer;

a dielectric constant layer disposed on the metallic plates so as to place first portions of the connection portions in the dielectric constant layer and to be spaced away from a first surface of the conductive layer; and a second dielectric layer disposed on a second surface of the conductive layer opposite to the first surface;

wherein a surface of the metallic plates faces the linear antenna and acts as the band gap surface.

15. An antenna apparatus comprising:

a ground plane having a band gap surface on a first side of the ground plane such that the band gap surface is conductive and substantially prevents propagation of electromagnetic waves set within a specific frequency band; and a traveling-wave linear antenna, disposed over the band gap surface on the first side of the ground plane and spaced away from the band gap surface, which linear antenna radiates electromagnetic waves of an operational frequency placed within the specific frequency band in response to an alternating current of the operational frequency inputted to the linear antenna to output a communication signal contained in the alternating current, an end portion, extending from an end of the linear antenna to be inserted into a through hole of the ground plane; and a matching stub, disposed on a surface of the ground plane on a second side of the ground plane opposite to the first side and connected with the end portion, which terminates the linear antenna to prevent waves of the alternating current from being reflected in the linear antenna.

16. An antenna apparatus comprising:

a ground plane having a band gap surface on a first side of the ground plane such that the band gap surface is conductive and substantially prevents propagation of electromagnetic waves set within a specific frequency band; and a traveling-wave linear antenna, disposed over the band gap surface on the first side of the ground plane and spaced away from the band gap surface, which linear antenna radiates electromagnetic waves of an operational frequency placed within the specific frequency band in response to an alternating current of the operational frequency inputted to the linear antenna to output a communication signal contained in the alternating current, a feed terminal, disposed on a surface of the ground plane on a second side of the ground plane opposite to the first side, which receives the alternating current;

a first end portion inserted into a hole of the ground plane penetrating through the ground plane between the first and second sides;

a second end portion inserted into another hole of the ground plane penetrating through the ground plane between the first and second sides; and a distributor which distributes the alternating current received in the feed terminal to the first and second end portions on the second side of the ground plane, wherein the linear antenna comprises:

a first antenna connected with the first end portion; and a second antenna connected with the second end portion.

* * * * *